US008192281B2

(12) United States Patent
Williams et al.

(10) Patent No.: US 8,192,281 B2
(45) Date of Patent: Jun. 5, 2012

(54) SIMULATED REEL IMPERFECTIONS

(75) Inventors: David C. Williams, Carson City, NV (US); Joseph R. Hedrick, Reno, NV (US); Kurt Larsen, Reno, NV (US)

(73) Assignee: IGT, Reno, NV (US)

( * ) Notice: Subject to any disclaimer, the term of this patent is extended or adjusted under 35 U.S.C. 154(b) by 1116 days.

(21) Appl. No.: 11/858,793

(22) Filed: Sep. 20, 2007

(65) Prior Publication Data

US 2008/0113748 A1 May 15, 2008

Related U.S. Application Data

(60) Provisional application No. 60/858,741, filed on Nov. 13, 2006.

(51) Int. Cl.
*A63F 9/24* (2006.01)

(52) U.S. Cl. ..... 463/31; 463/4; 463/5

(58) Field of Classification Search ..... 463/31, 463/4, 5

See application file for complete search history.

(56) References Cited

U.S. PATENT DOCUMENTS

| | | | |
|---|---|---|---|
| 3,708,219 | A | 1/1973 | Forlini et al. |
| 4,333,715 | A | 6/1982 | Brooks |
| 4,517,558 | A | 5/1985 | Davids |
| 4,574,391 | A | 3/1986 | Morishima |
| 4,607,844 | A | 8/1986 | Fullerton |
| 4,621,814 | A | 11/1986 | Stephen et al. |
| 4,659,182 | A | 4/1987 | Aizawa |
| 4,718,672 | A | 1/1988 | Okada |
| 4,911,449 | A | 3/1990 | Dickinson et al. |
| 4,912,548 | A | 3/1990 | Shanker et al. |
| 5,086,354 | A | 2/1992 | Bass et al. |
| 5,113,272 | A | 5/1992 | Reamey |
| 5,132,839 | A | 7/1992 | Travis |
| 5,152,529 | A | 10/1992 | Okada |
| 5,319,491 | A | 6/1994 | Selbrede |
| 5,342,047 | A | 8/1994 | Heidel et al. |
| 5,364,100 | A | 11/1994 | Ludlow et al. |
| 5,375,830 | A | 12/1994 | Takemoto et al. |
| 5,376,587 | A | 12/1994 | Buchmann et al. |
| 5,393,057 | A | 2/1995 | Marnell |
| 5,393,061 | A | 2/1995 | Manship et al. |
| 5,395,111 | A | 3/1995 | Inoue |
| 5,467,893 | A | 11/1995 | Landis, II et al. |
| 5,539,547 | A | 7/1996 | Ishii et al. |
| 5,580,055 | A | 12/1996 | Hagiwara |

(Continued)

FOREIGN PATENT DOCUMENTS

| | | |
|---|---|---|
| AU | 721968 | 7/2000 |

(Continued)

OTHER PUBLICATIONS

International Search Report, 5 page document, International Application No. PCT/US2005/000950, Dated Jun. 2, 2005.

(Continued)

*Primary Examiner* — Pierre E Elisca
(74) *Attorney, Agent, or Firm* — Weaver Austin Villeneuve & Sampson LLP

(57) ABSTRACT

Described herein is a gaming machine configured to output video data that simulates mechanical reels in a traditional mechanical slot machine. Embodiments described herein contribute to the emulation of a mechanical machine by simulating one or more visible mechanical imperfections commonly found in a mechanical reel machine.

20 Claims, 9 Drawing Sheets

U.S. PATENT DOCUMENTS

| | | | |
|---|---|---|---|
| 5,585,821 | A | 12/1996 | Ishikura et al. |
| 5,589,980 | A | 12/1996 | Bass et al. |
| 5,647,798 | A | 7/1997 | Falciglia |
| 5,725,428 | A | 3/1998 | Achmuller |
| 5,745,197 | A | 4/1998 | Leung et al. |
| 5,752,881 | A | 5/1998 | Inoue |
| 5,762,552 | A | 6/1998 | Vuong et al. |
| 5,764,317 | A | 6/1998 | Sadovnik et al. |
| 5,785,315 | A | 7/1998 | Eiteneer et al. |
| 5,788,573 | A | 8/1998 | Baerlocher et al. |
| 5,833,537 | A | 11/1998 | Barrie |
| 5,851,148 | A | 12/1998 | Brune et al. |
| 5,910,046 | A | 6/1999 | Wada et al. |
| 5,923,307 | A | 7/1999 | Hogle, IV |
| 5,951,397 | A | 9/1999 | Dickinson |
| 5,956,180 | A | 9/1999 | Bass et al. |
| 5,967,893 | A | 10/1999 | Lawrence et al. |
| 5,988,638 | A | 11/1999 | Rodesch et al. |
| 5,993,027 | A | 11/1999 | Yamamoto et al. |
| 6,001,016 | A | 12/1999 | Walker et al. |
| 6,015,346 | A | 1/2000 | Bennett |
| 6,027,115 | A | 2/2000 | Griswold et al. |
| 6,050,895 | A | 4/2000 | Luciano, Jr. et al. |
| 6,054,969 | A | 4/2000 | Haisma |
| 6,057,814 | A | 5/2000 | Kalt |
| 6,059,289 | A | 5/2000 | Vancura |
| 6,059,658 | A | 5/2000 | Mangano et al. |
| 6,068,552 | A | 5/2000 | Walker |
| 6,086,066 | A | 7/2000 | Takeuchi et al. |
| 6,093,102 | A | 7/2000 | Bennett |
| 6,135,884 | A | 10/2000 | Hedrick et al. |
| 6,159,095 | A | 12/2000 | Frohm et al. |
| 6,159,098 | A | 12/2000 | Slomiany et al. |
| 6,168,520 | B1 | 1/2001 | Baerlocher et al. |
| 6,190,255 | B1 | 2/2001 | Thomas et al. |
| 6,213,875 | B1 | 4/2001 | Suzuki |
| 6,227,971 | B1 | 5/2001 | Weiss |
| 6,234,897 | B1 | 5/2001 | Frohm et al. |
| 6,244,596 | B1 | 6/2001 | Kondratjuk |
| 6,251,013 | B1 | 6/2001 | Bennett |
| 6,251,014 | B1 | 6/2001 | Stockdale et al. |
| 6,252,707 | B1 | 6/2001 | Kleinberger et al. |
| 6,254,481 | B1 | 7/2001 | Jaffe |
| 6,261,178 | B1 | 7/2001 | Bennett |
| 6,270,411 | B1 | 8/2001 | Gura et al. |
| 6,297,785 | B1 | 10/2001 | Sommer et al. |
| 6,315,666 | B1 | 11/2001 | Mastera et al. |
| 6,322,445 | B1 | 11/2001 | Miller |
| 6,337,513 | B1 | 1/2002 | Clevenger et al. |
| 6,347,996 | B1 | 2/2002 | Gilmore et al. |
| 6,368,216 | B1 | 4/2002 | Hedrick et al. |
| 6,379,244 | B1 | 4/2002 | Sagawa et al. |
| 6,398,220 | B1 | 6/2002 | Inoue |
| 6,416,827 | B1 | 7/2002 | Chakrapani et al. |
| 6,444,496 | B1 | 9/2002 | Edwards et al. |
| 6,445,185 | B1 | 9/2002 | Damadian et al. |
| 6,491,583 | B1 | 12/2002 | Gauselmann |
| 6,503,147 | B1 | 1/2003 | Stockdale et al. |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,433 | B2 | 2/2003 | Loose et al. |
| 6,517,437 | B1 | 2/2003 | Wells et al. |
| 6,520,856 | B1 | 2/2003 | Walker et al. |
| 6,532,146 | B1 | 3/2003 | Duquette |
| 6,547,664 | B2 | 4/2003 | Saunders |
| 6,575,541 | B1 | 6/2003 | Hedrick et al. |
| 6,585,591 | B1 | 7/2003 | Baerlocher et al. |
| 6,612,927 | B1 | 9/2003 | Slomiany |
| D480,961 | S | 10/2003 | Deadman |
| 6,643,124 | B1 | 11/2003 | Wilk |
| 6,644,664 | B2 | 11/2003 | Muir et al. |
| 6,646,695 | B1 | 11/2003 | Gauselmann |
| 6,652,378 | B2 | 11/2003 | Cannon et al. |
| 6,659,864 | B2 | 12/2003 | McGahn et al. |
| 6,661,425 | B1 | 12/2003 | Hiroaki |
| 6,695,696 | B1 | 2/2004 | Kaminkow |
| 6,695,703 | B1 | 2/2004 | McGahn |
| 6,702,675 | B2 | 3/2004 | Poole et al. |
| 6,712,694 | B1 | 3/2004 | Nordman |
| 6,715,756 | B2 | 4/2004 | Inoue |
| 6,717,728 | B2 | 4/2004 | Putilin |
| 6,722,979 | B2 | 4/2004 | Gilmore et al. |
| 6,802,777 | B2 | 10/2004 | Seelig et al. |
| 6,817,945 | B2 | 11/2004 | Seelig et al. |
| 6,817,946 | B2 | 11/2004 | Motegi et al. |
| 6,859,219 | B1 | 2/2005 | Sall |
| 6,887,157 | B2 | 5/2005 | LeMay et al. |
| 6,890,259 | B2 | 5/2005 | Breckner et al. |
| 6,906,762 | B1 | 6/2005 | Witehira et al. |
| 6,908,381 | B2 | 6/2005 | Ellis |
| 6,937,298 | B2 | 8/2005 | Okada |
| 6,981,635 | B1 | 1/2006 | Hughs-Baird et al. |
| 7,040,987 | B2 | 5/2006 | Walker et al. |
| 7,056,215 | B1 | 6/2006 | Olive |
| 7,095,180 | B2 | 8/2006 | Emslie et al. |
| 7,097,560 | B2 | 8/2006 | Okada |
| 7,108,603 | B2 | 9/2006 | Olive |
| 7,115,033 | B1 | 10/2006 | Timperley |
| 7,128,647 | B2 | 10/2006 | Muir |
| 7,159,865 | B2 | 1/2007 | Okada |
| 7,160,187 | B2 | 1/2007 | Loose et al. |
| 7,166,029 | B2 | 1/2007 | Enzminger |
| 7,204,753 | B2 | 4/2007 | Ozaki et al. |
| 7,207,883 | B2 | 4/2007 | Nozaki et al. |
| 7,220,181 | B2 | 5/2007 | Okada |
| 7,227,510 | B2 | 6/2007 | Mayer, III et al. |
| 7,237,202 | B2 | 6/2007 | Gage |
| 7,252,288 | B2 | 8/2007 | Seelig et al. |
| 7,252,591 | B2 | 8/2007 | Van Asdale |
| 7,255,643 | B2 | 8/2007 | Ozaki et al. |
| 7,274,413 | B1 | 9/2007 | Sullivan et al. |
| 7,285,049 | B1 | 10/2007 | Luciano, Jr. et al. |
| 7,309,284 | B2 | 12/2007 | Griswold et al. |
| 7,322,884 | B2 | 1/2008 | Emori et al. |
| 7,324,094 | B2 | 1/2008 | Moilanen et al. |
| 7,329,181 | B2 | 2/2008 | Hoshino et al. |
| 7,352,424 | B2 | 4/2008 | Searle |
| 7,439,683 | B2 | 10/2008 | Emslie et al. |
| 7,473,173 | B2 | 1/2009 | Peterson et al. |
| 7,505,049 | B2 | 3/2009 | Engel |
| 7,510,475 | B2 | 3/2009 | Loose et al. |
| 7,558,057 | B1 | 7/2009 | Naksen et al. |
| 7,559,837 | B1 | 7/2009 | Yoseloff et al. |
| 7,619,585 | B2 | 11/2009 | Bell et al. |
| 7,624,339 | B1 | 11/2009 | Engel et al. |
| 7,626,594 | B1 | 12/2009 | Witehira et al. |
| 7,724,208 | B1 | 5/2010 | Engel et al. |
| 7,730,413 | B1 | 6/2010 | Engel |
| 7,742,124 | B2 | 6/2010 | Bell |
| 7,742,239 | B2 | 6/2010 | Bell |
| 7,841,944 | B2 | 11/2010 | Wells |
| 7,951,001 | B2 | 5/2011 | Wells |
| 8,012,010 | B2 | 9/2011 | Wilson et al. |
| 2001/0013681 | A1 | 8/2001 | Bruzzese et al. |
| 2001/0016513 | A1 | 8/2001 | Muir et al. |
| 2001/0031658 | A1 | 10/2001 | Ozaki et al. |
| 2002/0022518 | A1 | 2/2002 | Okuda et al. |
| 2002/0045472 | A1 | 4/2002 | Adams |
| 2002/0086725 | A1 | 7/2002 | Fasbender et al. |
| 2002/0119035 | A1 | 8/2002 | Hamilton |
| 2002/0142825 | A1 | 10/2002 | Lark et al. |
| 2002/0167637 | A1 | 11/2002 | Burke |
| 2002/0173354 | A1 | 11/2002 | Winans et al. |
| 2002/0175466 | A1 | 11/2002 | Loose et al. |
| 2002/0183105 | A1 | 12/2002 | Cannon |
| 2002/0183109 | A1 | 12/2002 | McGahn et al. |
| 2003/0026171 | A1 | 2/2003 | Brewer et al. |
| 2003/0027624 | A1 | 2/2003 | Gilmore et al. |
| 2003/0032478 | A1 | 2/2003 | Takahama et al. |
| 2003/0032479 | A1 | 2/2003 | LeMay et al. |
| 2003/0045345 | A1 | 3/2003 | Berman |
| 2003/0060271 | A1 | 3/2003 | Gilmore et al. |
| 2003/0064781 | A1 | 4/2003 | Muir |
| 2003/0069063 | A1 | 4/2003 | Bilyeu et al. |
| 2003/0087690 | A1 | 5/2003 | Loose et al. |
| 2003/0128427 | A1 | 7/2003 | Kalmanash |

2003/0130026 A1 7/2003 Breckner et al.
2003/0130028 A1 7/2003 Aida et al.
2003/0148804 A1 8/2003 Ikeya et al.
2003/0157980 A1 8/2003 Loose et al.
2003/0176214 A1 9/2003 Burak et al.
2003/0199295 A1 10/2003 Vancura
2003/0220134 A1 11/2003 Walker et al.
2003/0234489 A1 12/2003 Okada
2003/0236114 A1 12/2003 Griswold et al.
2003/0236118 A1 12/2003 Okada
2004/0009803 A1 1/2004 Bennett et al.
2004/0023714 A1 2/2004 Asdale
2004/0029636 A1 2/2004 Wells
2004/0036218 A1 2/2004 Inoue
2004/0063490 A1 4/2004 Okada
2004/0066475 A1 4/2004 Searle
2004/0077401 A1 4/2004 Schlottmann et al.
2004/0102244 A1 5/2004 Kryuchkov et al.
2004/0102245 A1 5/2004 Escalera et al.
2004/0116178 A1 6/2004 Okada
2004/0142748 A1 7/2004 Loose et al.
2004/0147303 A1 7/2004 Imura et al.
2004/0150162 A1 8/2004 Okada
2004/0162146 A1 8/2004 Ooto
2004/0166925 A1 8/2004 Emori et al.
2004/0166927 A1 8/2004 Okada
2004/0171423 A1 9/2004 Silva et al.
2004/0183251 A1 9/2004 Inoue
2004/0183972 A1 9/2004 Bell
2004/0192430 A1 9/2004 Burak et al.
2004/0198485 A1 10/2004 Loose
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209672 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0219967 A1 11/2004 Giobbi et al.
2004/0224747 A1 11/2004 Okada
2004/0227721 A1 11/2004 Moilanen et al.
2004/0233663 A1 11/2004 Emslie et al.
2004/0235558 A1 11/2004 Beaulieu et al.
2004/0239582 A1 12/2004 Seymour
2004/0266515 A1 12/2004 Gauselmann
2004/0266536 A1 12/2004 Mattice et al.
2005/0020348 A1 1/2005 Thomas et al.
2005/0026673 A1 2/2005 Paulsen et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0052341 A1 3/2005 Henriksson
2005/0062410 A1 3/2005 Bell et al.
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0164786 A1 7/2005 Connelly
2005/0176493 A1 8/2005 Nozaki et al.
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0253775 A1 11/2005 Stewart
2005/0255908 A1 11/2005 Wells et al.
2005/0266912 A1 12/2005 Sekiguchi
2005/0285337 A1 12/2005 Durham et al.
2006/0025199 A1 2/2006 Harkins et al.
2006/0058100 A1 3/2006 Pacey et al.
2006/0063580 A1 3/2006 Nguyen et al.
2006/0073881 A1 4/2006 Pryzby
2006/0100014 A1 5/2006 Griswold et al.
2006/0103951 A1 5/2006 Bell et al.
2006/0111179 A1 5/2006 Inamura
2006/0125745 A1 6/2006 Evanicky
2006/0166727 A1 7/2006 Burak
2006/0191177 A1 8/2006 Engel
2006/0256033 A1 11/2006 Chan et al.
2006/0284574 A1 12/2006 Emslie et al.
2006/0290594 A1 12/2006 Engel et al.
2007/0004510 A1 1/2007 Underdahl et al.
2007/0004513 A1 1/2007 Wells et al.
2007/0010315 A1 1/2007 Hein
2007/0057866 A1 3/2007 Lee et al.
2007/0072665 A1 3/2007 Muir
2007/0077986 A1 4/2007 Loose
2007/0091011 A1 4/2007 Selbrede
2007/0105610 A1 5/2007 Anderson
2007/0105611 A1 5/2007 O'Halloran
2007/0105628 A1 5/2007 Arbogast et al.
2007/0252804 A1 11/2007 Engel
2008/0004104 A1 1/2008 Durham et al.
2008/0007486 A1 1/2008 Fujinawa et al.
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0064497 A1 3/2008 Griswold et al.
2008/0068290 A1 3/2008 Muklashy et al.
2008/0096655 A1 4/2008 Rasmussen et al.
2008/0108422 A1 5/2008 Hedrick et al.
2008/0113716 A1* 5/2008 Beadell et al. ..... 463/17
2008/0113745 A1 5/2008 Williams et al.
2008/0113746 A1* 5/2008 Williams et al. ..... 463/20
2008/0113747 A1 5/2008 Williams et al.
2008/0113748 A1* 5/2008 Williams et al. ..... 463/20
2008/0113749 A1 5/2008 Williams et al.
2008/0113756 A1 5/2008 Williams et al.
2008/0113775 A1 5/2008 Williams et al.
2008/0125219 A1 5/2008 Williams et al.
2008/0136741 A1 6/2008 Williams et al.
2008/0261674 A9 10/2008 Okada
2008/0284792 A1 11/2008 Bell
2009/0036208 A1* 2/2009 Pennington et al. ..... 463/33
2009/0061983 A1* 3/2009 Kaufman ..... 463/20
2009/0061984 A1 3/2009 Yi et al.
2009/0069069 A1* 3/2009 Crowder et al. ..... 463/20
2009/0069070 A1* 3/2009 Crowder et al. ..... 463/20
2009/0079667 A1* 3/2009 Schlottmann et al. ..... 345/6
2009/0082083 A1 3/2009 Wilson et al.
2009/0091513 A1 4/2009 Kuhn
2009/0104989 A1 4/2009 Williams et al.
2009/0258697 A1* 10/2009 Kelly et al. ..... 463/20
2009/0258701 A1* 10/2009 Crowder et al. ..... 463/34
2009/0280888 A1 11/2009 Durham et al.
2009/0312095 A1 12/2009 Durham et al.
2010/0045601 A1 2/2010 Engel et al.
2010/0115391 A1 5/2010 Engel et al.
2010/0115439 A1 5/2010 Engel
2010/0190545 A1 7/2010 Lauzon et al.
2010/0214195 A1 8/2010 Ogasawara et al.
2010/0234089 A1 9/2010 Saffari et al.
2011/0065490 A1* 3/2011 Lutnick ..... 463/16
2011/0201404 A1 8/2011 Wells
2011/0294562 A1 12/2011 Wilson et al.

FOREIGN PATENT DOCUMENTS

AU 2000PQ9586 8/2000
CA 2265283 9/1999
EP 0 454 423 10/1991
EP 0 484 103 5/1992
EP 0 860 807 8/1998
EP 0 919 965 6/1999
EP 0 997 857 10/1999
EP 1 000 642 A2 5/2000
EP 1 260 928 11/2002
EP 1 282 088 2/2003
EP 1 369 830 AI 12/2003
EP 1 391 847 2/2004
EP 1 462 152 A2 9/2004
EP 1 492 063 12/2004
EP 1 826 739 8/2007

| | | | |
|---|---|---|---|
| GB | 1 464 896 | | 2/1977 |
| GB | 2 120 506 | | 11/1983 |
| GB | 2 253 300 | | 9/1992 |
| GB | 2 316 214 | | 2/1998 |
| GB | 2 385 004 | A | 8/2003 |
| JP | H02-90884 | | 7/1990 |
| JP | H03-20388 | | 2/1991 |
| JP | 04-220276 | | 8/1992 |
| JP | H05-68585 | | 9/1993 |
| JP | 06-043425 | | 2/1994 |
| JP | 07-124290 | | 5/1995 |
| JP | H10-015247 | | 1/1998 |
| JP | 10-234932 | A | 9/1998 |
| JP | 11-000441 | A | 1/1999 |
| JP | H11-137852 | | 5/1999 |
| JP | 2000-300729 | | 10/2000 |
| JP | 00-350805 | | 12/2000 |
| JP | 2000-350805 | | 12/2000 |
| JP | 2000-354685 | | 12/2000 |
| JP | 01-062032 | | 3/2001 |
| JP | 2001-062032 | | 3/2001 |
| JP | 01-238995 | | 9/2001 |
| JP | 01-252393 | | 9/2001 |
| JP | 01-252394 | | 9/2001 |
| JP | 2001-238995 | | 9/2001 |
| JP | 2001-252393 | | 9/2001 |
| JP | 2001-252394 | | 9/2001 |
| JP | 02-085624 | | 3/2002 |
| JP | 2002-085624 | | 3/2002 |
| JP | 2004-089707 | | 3/2004 |
| JP | 2004-105616 | | 4/2004 |
| JP | 04-166879 | | 6/2004 |
| JP | 2004-166879 | | 6/2004 |
| JP | 2005-253561 | | 9/2005 |
| JP | 2005-266387 | | 9/2005 |
| JP | 2005-266388 | | 9/2005 |
| JP | 2005-274906 | | 10/2005 |
| JP | 2005-274907 | | 10/2005 |
| JP | 2005-283864 | | 10/2005 |
| JP | 2006-043425 | | 2/2006 |
| JP | 2006-059607 | | 3/2006 |
| JP | 2006-346226 | | 12/2006 |
| JP | 2007-200869 | | 8/2007 |
| RU | 2 053 559 | C1 | 1/1996 |
| RU | 2 145 116 | C1 | 1/2000 |
| RU | 29794 | U1 | 5/2003 |
| WO | WO 93/13446 | | 7/1993 |
| WO | 99/42889 | | 8/1999 |
| WO | 99/44095 | | 9/1999 |
| WO | WO 99/53454 | | 10/1999 |
| WO | WO 00/32286 | | 6/2000 |
| WO | 01/15127 | | 3/2001 |
| WO | 01/15128 | | 3/2001 |
| WO | 01/15132 | | 3/2001 |
| WO | WO 01/38926 | | 5/2001 |
| WO | 01/09664 | | 8/2001 |
| WO | WO 02/41046 | | 5/2002 |
| WO | WO 02/084637 | | 10/2002 |
| WO | WO 02/086610 | | 10/2002 |
| WO | WO 02/089102 | | 11/2002 |
| WO | WO 03/001486 | | 1/2003 |
| WO | WO 03/023491 | | 3/2003 |
| WO | WO 03/032058 | | 4/2003 |
| WO | 03/039699 | | 5/2003 |
| WO | WO 03/040820 | | 5/2003 |
| WO | PCT/NZ2003/00153 | | 7/2003 |
| WO | WO 03/079094 | | 9/2003 |
| WO | 2004/001486 | | 12/2003 |
| WO | WO 2004/001488 | | 12/2003 |
| WO | WO 2004/002143 | | 12/2003 |
| WO | WO 2004/008226 | | 1/2004 |
| WO | WO 2004/023825 | | 3/2004 |
| WO | WO 2004/025583 | | 3/2004 |
| WO | WO 2004/036286 | | 4/2004 |
| WO | WO 2004/060512 | | 7/2004 |
| WO | WO 2004/079674 | | 9/2004 |
| WO | 2004/102520 | | 11/2004 |
| WO | WO 2005/071629 | A1 | 8/2005 |
| WO | 2006/034192 | | 3/2006 |
| WO | 2006/038819 | | 4/2006 |
| WO | WO 2006/112740 | | 10/2006 |
| WO | WO 2007/040413 | | 4/2007 |
| WO | WO 2008/005278 | | 1/2008 |
| WO | WO 2008/028153 | | 3/2008 |
| WO | WO 2008/048857 | | 4/2008 |
| WO | WO 2008/061068 | | 5/2008 |
| WO | WO 2008/062914 | | 5/2008 |
| WO | WO 2008/063908 | | 5/2008 |
| WO | WO 2008/063914 | | 5/2008 |
| WO | WO 2008/063952 | | 5/2008 |
| WO | WO 2008/063956 | | 5/2008 |
| WO | WO 2008/063968 | | 5/2008 |
| WO | WO 2008/063969 | | 5/2008 |
| WO | WO 2008/063971 | | 5/2008 |
| WO | WO 2008/079542 | | 7/2008 |
| WO | WO 2009/029720 | | 3/2009 |
| WO | WO 2009/039245 | | 3/2009 |
| WO | WO 2009/039295 | | 3/2009 |
| WO | WO 2009/054861 | | 4/2009 |
| WO | WO 2010/023537 | | 3/2010 |
| WO | WO 2010/039411 | | 4/2010 |

OTHER PUBLICATIONS

Written Opinion of the International Searching Authority, 7 page document, International Application No. PCT/US2005/000950, Dated Jun. 2, 2005.

"Light Valve". [online] [retrieved on Nov. 15, 2005]. Retrieved from the Internet URL http://www.meko.co.uk/lightvalve .shtml (1 page).

"Liquid Crystal Display". [online]. [retrieved on Nov. 16, 2005]. Retrieved form the Internet URL http://en.wikipedia.org/wiki/LCD (6 pages).

Bonsor, Kevin, "How Smart Windows Will Work," Howstuffworks, Inc. 1998-2002, http://www/howstuffworks.com/smart-window.htm/printable. Printed Nov. 25, 2002 (5 pages).

"What is SPD?" SPD Systems, Inc. 2002, http://www.spd-systems.com/spdq.htm. Printed Dec. 4, 2002 (2 pages).

"Debut of the Let's Make a Deal Slot Machine," Let's Make a Deal 1999-2002, http:///www.letsmakeadeal.com/pr01.htm. Printed Dec. 3, 2002 (2 pages).

Living in a flat world? Advertisement written by Deep Video Imaging Ltd., published 2000.

Novel 3-D Video Display Technology Developed, News release: Aug. 30, 1996, www.eurekalert.org/summaries/1199.html, printed from Internet Archive using date Sep. 2, 2000.

Time Multiplexed Optical Shutter (TMOS): A revolutionary Flat Screen Display Technology, www.vea.com/TMOS.html, Apr. 8, 1999, printed from Internet Archive using date Oct. 6, 1999.

Time Multiplexed Optical Shutter (TMOS): A revolutionary Flat Screen Display Technology, www.tralas.com/TMOS.html, Apr. 5, 2001, printed from Internet Archive using date Apr. 11, 2001.

Written Opinion of the International Searching Authority dated May 25, 2005, for PCT Application No. PCT/US2005/000597.

Bosner, "How Smart Windows Work," HowStuffWorks, Inc.,www.howstuffworks.com, 1998-2004, 9 pages.

Saxe et al., "Suspended-Particle Devices," www.refr-spd.com, Apr./May 1996, 5 pages.

"SPD," Malvino Inc., www.malvino.com, Jul. 19, 1999, 10 pages.

International Exam Report dated Sep. 21, 2007 in European Application No. 05 705 315.9.

U.S. Appl. No. 11/849,119, filed Aug. 31, 2007.

U.S. Appl. No. 11/858,695, filed Sep. 20, 2007.

U.S. Appl. No. 11/858,845, filed Sep. 20, 2007.

U.S. Appl. No. 11/858,849, filed Sep. 20, 2007.

U.S. Appl. No. 11/859,127, filed Sep. 21, 2007.

U.S. Appl. No. 11/938,184, filed Nov. 9, 2007.

U.S. Appl. No. 11/877,611, filed Oct. 23, 2007.

U.S. Appl. No. 11/938,086, filed Nov. 9, 2007.

U.S. Appl. No. 11/938,151, filed Nov. 9, 2007.

Office Action dated Aug. 29, 2007 from U.S. Appl. No. 10/755,598.

Office Action dated Oct. 31, 2007 from U.S. Appl. No. 10/213,626.

Final Office Action dated Mar. 28, 2007 from U.S. Appl. No. 10/213,626.

Office Action dated Apr. 27, 2006 from U.S. Appl. No. 10/213,626.

Final Office Action dated Jan. 10, 2006 from U.S. Appl. No. 10/213,626.
Office Action dated Aug. 31, 2004 from U.S. Appl. No. 10/213,626.
International Search Report and Written Opinion, mailed on May 8, 2008, PCT/US2007/084121.
U.S. Appl. No. 09/622,409, dated Nov. 6, 2000, Engel.
U.S. Appl. No. 12/849,284, dated Aug. 3, 2010, Silva.
U.S. Appl. No. 13/094,259, dated Apr. 26, 2011, Wells.
U.S. Appl. No. 13/027,260, dated Aug. 10, 2011, Wilson.
U.S. Office Action dated Mar. 30, 2010 issued in U.S. Appl. No. 11/938,086.
U.S. Office Action Final dated Aug. 19, 2010 issued in U.S. Appl. No. 11/938,086.
U.S. Office Action dated Dec. 3, 2010 issued in U.S. Appl. No. 11/938,086.
U.S. Notice of Allowance dated Apr. 18, 2011 issued in U.S. Appl. No. 11/938,086.
U.S. Notice of Allowance dated Oct. 7, 2011 issued in U.S. Appl. No. 11/938,086.
U.S. Office Action dated Oct. 9, 2009 issued in U.S. Appl. No. 11/514,808.
U.S. Office Action Final dated Apr. 22, 2010 issued in U.S. Appl. No. 11/514,808.
U.S. Office Action and Examiner Interview Summary dated Oct. 18, 2010 issued in U.S. Appl. No. 11/514,808.
U.S. Office Action Final dated Apr. 27, 2011 issued in U.S. Appl. No. 11/514,808.
U.S. Office Action dated Dec. 2, 2009 issued in U.S. Appl. No. 11/829,852.
U.S. Office Action dated Jul. 14, 2010 issued in U.S. Appl. No. 11/829,852.
U.S. Office Action dated Nov. 14, 2008 issued in U.S. Appl. No. 11/829,853.
U.S. Office Action dated Oct. 31, 2008 issued in U.S. Appl. No. 11/829,849.
U.S. Office Action dated Oct. 5, 2011 issued in U.S. Appl. No. 12/245,490.
U.S. Office Action Final dated Apr. 23, 2008 issued in U.S. Appl. No. 10/755,598.
U.S. Office Action dated Oct. 8, 2008 issued in U.S. Appl. No. 10/755,598.
U.S. Office Action Final dated Jul. 1, 2009 issued in U.S. Appl. No. 10/755,598.
U.S. Office Action Final dated Jan. 22, 2010 issued in U.S. Appl. No. 10/755,598.
U.S. Office Action Final dated Aug. 4, 2010 issued in U.S. Appl. No. 10/755,598.
U.S. Notice of Panel Decision from Pre-Appeal Brief Review dated Dec. 1, 2010 issued in U.S. Appl. No. 10/755,598.
U.S. Office Action dated Mar. 28, 2011 issued in U.S. Appl. No. 10/755,598.
U.S. Office Action Final dated Nov. 8, 2011 issued in U.S. Appl. No. 10/755,598.
U.S. Office Action dated Oct. 31, 2008 issued in U.S. Appl. No. 11/829,917.
U.S. Office Action Final dated Aug. 11, 2009 issued in U.S. Appl. No. 11/829,917.
U.S. Office Action dated Jan. 29, 2010 issued in U.S. Appl. No. 11/829,917.
U.S. Office Action Final dated Aug. 5, 2010 issued in U.S. Appl. No. 11/829,917.
U.S. Office Action dated Jun. 23, 2009 issued in U.S. Appl. No. 11/938,151.
U.S. Office Action Final dated Feb. 8, 2010 issued in U.S. Appl. No. 11/938,151.
U.S. Advisory Action dated Apr. 22, 2010 issued in U.S. Appl. No. 11/938,151.
U.S. Office Action dated Jul. 23, 2010 issued in U.S. Appl. No. 11/938,151.
U.S. Office Action Final dated Jan. 4, 2011 issued in U.S. Appl. No. 11/938,151.
U.S. Office Action (Notice of Panel Decision from Pre-Appeal Brief Review) dated Apr. 27, 2011 issued in U.S. Appl. No. 11/938,151.
U.S. Notice of Allowance dated Sep. 12, 2011 issued in U.S. Appl. No. 11/938,151.
U.S. Office Action dated Jul. 9, 2010 issued in U.S. Appl. No. 11/858,849.
U.S. Office Action Final dated Nov. 30, 2010 issued in U.S. Appl. No. 11/858,849.
U.S. Office Action dated Mar. 22, 2011 issued in U.S. Appl. No. 11/858,849.
U.S. Office Action Final dated Aug. 11, 2011 issued in U.S. Appl. No. 11/858,849.
U.S. Office Action (Advisory Action) dated Dec. 2, 2011 issued in U.S. Appl. No. 11/858,849.
U.S. Notice of Allowance and Allowability dated Dec. 14, 2011 issued in U.S. Appl. No. 11/858,849.
U.S. Office Action dated Jul. 9, 2009 issued in U.S. Appl. No. 11/858,700.
U.S. Office Action Final dated Jan. 4, 2010 issued in U.S. Appl. No. 11/858,700.
U.S. Office Action Final dated Apr. 7, 2010 issued in U.S. Appl. No. 11/858,700.
U.S. Office Action dated Aug. 5, 2010 issued in U.S. Appl. No. 11/858,700.
U.S. Office Action Final dated Dec. 27, 2010 issued in U.S. Appl. No. 11/858,700.
U.S. Office Action dated Nov. 18, 2011 issued in U.S. Appl. No. 11/858,700.
U.S. Office Action dated Jul. 9, 2009 issued in U.S. Appl. No. 11/858,695.
U.S. Office Action Final dated Jan. 4, 2010 issued in U.S. Appl. No. 11/858,695.
U.S. Office Action Final dated Mar. 29, 2010 issued in U.S. Appl. No. 11/858,695.
U.S. Office Action Final dated Jul. 7, 2010 issued in U.S. Appl. No. 11/858,695.
U.S. Office Action dated Nov. 28, 2011 issued in U.S. Appl. No. 11/858,695.
U.S. Office Action dated Jul. 9, 2009 issued in U.S. Appl. No. 11/858,693.
U.S. Office Action Final dated Mar. 23, 2010 issued in U.S. Appl. No. 11/858,693.
U.S. Advisory Action dated Jun. 1, 2010 issued in U.S. Appl. No. 11/858,693.
U.S. Office Action dated Aug. 5, 2010 issued in U.S. Appl. No. 11/858,693.
U.S. Office Action Final dated Feb. 7, 2011 issued in U.S. Appl. No. 11/858,693.
U.S. Advisory Action dated Apr. 8, 2011 issued in U.S. Appl. No. 11/858,693.
U.S. Notice of Allowance dated Nov. 21, 2011 issued in U.S. Appl. No. 11/858,693.
U.S. Office Action dated Jul. 10, 2009 issued in U.S. Appl. No. 11/858,845.
U.S. Office Action Final dated Feb. 5, 2010 issued in U.S. Appl. No. 11/858,845.
U.S. Notice of Panel Decision from Pre-Appeal Brief Review dated Jun. 8, 2010 issued in U.S. Appl. No. 11/858,845.
U.S. Office Action dated Apr. 7, 2011 issued in U.S. Appl. No. 11/849,119.
U.S. Office Action Final dated Sep. 6, 2011 issued in U.S. Appl. No. 11/849,119.
U.S. Office Action dated Nov. 12, 2010 issued in U.S. Appl. No. 11/859,127.
U.S. Notice of Allowance dated May 4, 2011 issued in U.S. Appl. No. 11/859,127.
U.S. Office Action dated Jan. 20, 2011 issued in U.S. Appl. No. 11/983,770.
U.S. Office Action Final dated May 16, 2011 issued in U.S. Appl. No. 11/983,770.
U.S. Office Action dated Jun. 13, 2003 issued in U.S. Appl. No. 09/966,851.
U.S. Office Action dated Mar. 30, 2004 issued in U.S. Appl. No. 09/966,851.

U.S. Office Action Final dated Dec. 14, 2004 issued in U.S. Appl. No. 09/966,851.
U.S. Notice of Allowance dated Jun. 13, 2006 issued in U.S. Appl. No. 09/966,851.
U.S. Office Action dated Sep. 9, 2009 issued in U.S. Appl. No. 11/549,258.
U.S. Office Action Final dated Mar. 26, 2010 issued in U.S. Appl. No. 11/549,258.
U.S. Office Action dated Jul. 9, 2010 issued in U.S. Appl. No. 11/549,258.
U.S. Office Action Final dated Dec. 21, 2010 issued in U.S. Appl. No. 11/549,258.
U.S. Office Action dated Oct. 4, 2011 issued in U.S. Appl. No. 11/549,258.
U.S. Office Action dated Sep. 3, 010 issued in U.S. Appl. No. 11/938,632.
U.S. Office Action Final dated Dec. 15, 2010 issued in U.S. Appl. No. 11/938,632.
U.S. Advisory Action dated Mar. 16, 2011 issued in U.S. Appl. No. 11/938,632.
U.S. Notice of Allowance dated May 27, 2011 issued in U.S. Appl. No. 11/938,632.
U.S. Notice of Allowance dated Oct. 5, 2011 issued in U.S. Appl. No. 11/938,632.
U.S. Office Action dated Jun. 23, 2009 issued in U.S. Appl. No. 11/938,184.
U.S. Office Action Final dated Feb. 8, 2010 issued in U.S. Appl. No. 11/938,184.
U.S. Office Action dated Aug. 5, 2010 issued in U.S. Appl. No. 11/938,184.
U.S. Office Action Final dated Jan. 20, 2011 issued in U.S. Appl. No. 11/938,184.
U.S. Advisory Action dated Mar. 25, 2011 issued in U.S. Appl. No. 11/938,184.
U.S. Office Action dated Nov. 17, 2004 issued in U.S. Appl. No. 10/376,852.
U.S. Office Action dated Apr. 13, 2005 issued in U.S. Appl. No. 10/376,852.
U.S. Office Action Final dated Nov. 18, 2005 issued in U.S. Appl. No. 10/376,852.
U.S. Advisory Action dated Feb. 7, 2006 issued in U.S. Appl. No. 10/376,852.
U.S. Office Action dated Sep. 19, 2006 issued in U.S. Appl. No. 10/376,852.
U.S. Notice of Informal or Non-Responsive Amendment dated Mar. 9, 2007 issued in U.S. Appl. No. 10/376,852.
U.S. Office Action Final dated Jun. 22, 2007 issued in U.S. Appl. No. 10/376,852.
U.S. Office Action dated Jan. 28, 2008 issued in U.S. Appl. No. 10/376,852.
U.S. Office Action Final dated Aug. 6, 2008 issued in U.S. Appl. No. 10/376,852.
U.S. Office Action dated Feb. 2, 2009 issued in U.S. Appl. No. 10/376,852.
U.S. Notice of Allowance dated Nov. 10, 2009 issued in U.S. Appl. No. 10/376,852.
U.S. Office Action dated Mar. 25, 2010 issued in U.S. Appl. No. 10/376,852.
U.S. Advisory Action dated Apr. 5, 2006 issued in U.S. Appl. No. 10/213,626.
U.S. Interview Summary dated Jul. 17, 2007 issued in U.S. Appl. No. 10/213,626.
U.S. Office Action Final dated Aug. 29, 2008 issued in U.S. Appl. No. 10/213,626.
U.S. Office Action dated Jul. 9, 2009 issued in U.S. Appl. No. 10/213,626.
U.S. Notice of Allowance and Examiner Interview Summary dated Mar. 1, 2010 issued in U.S. Appl. No. 10/213,626.
U.S. Notice of Allowance dated Oct. 4, 2010 issued in U.S. Appl. No. 10/213,626.
U.S. Office Action dated May 24, 2007 issued in U.S. Appl. No. 11/167,655.
U.S. Office Action dated Jan. 3, 2008 issued in U.S. Appl. No. 11/167,655.
U.S. Office Action Final dated Mar. 8, 2008 issued in U.S. Appl. No. 11/167,655.
U.S. Office Action Final dated Sep. 2, 2008 issued in U.S. Appl. No. 11/167,655.
U.S. Office Action dated Jul. 17, 2009 issued in U.S. Appl. No. 11/167,655.
U.S. Notice of Allowance dated Mar. 11, 2010 issued in U.S. Appl. No. 11/167,655.
U.S. Notice of Allowance dated Jul. 7, 2010 issued in U.S. Appl. No. 11/167,655.
U.S. Notice of Allowance dated Dec. 10, 2010 issued in U.S. Appl. No. 11/167,655.
U.S. Notice of Allowance dated Apr. 1, 2011 issued in U.S. Appl. No. 11/167,655.
PCT International Search Report dated Apr. 9, 2008 issued in WO 2008/028153.
PCT Written Opinion dated Apr. 9, 2008 issued in WO 2008/028153.
PCT International Preliminary Report on Patentability and Written Opinion dated Mar. 3, 2009 issued in WO 2008/028153.
Australian Examiner's first report dated Jul. 25, 2011 issued in AU 2007289050.
European Examination Report dated Oct. 5, 2009 issued in EP 07 814 629.7.
PCT International Search Report dated Dec. 7, 2009 issued in WO 2010/039411.
PCT International Search Report dated May 25, 2005 issued in WO 2005/071629.
PCT International Preliminary Report on Patentability and Written Opinion dated Jul. 17, 2006 issued in WO 2005/071629.
Australian Examiner's First Report dated Nov. 12, 2009 issued in AU2005207309.
Australian Examiner's Report No. 2 dated Sep. 15, 2010 issued in AU Application No. 2005207309.
Chinese First Office Action dated Nov. 28, 2008 issued in CN2005800022940.
Chinese Second Office Action dated Sep. 25, 2009 issued in CN2005800022940.
Chinese Third Office Action dated May 11, 2010 issued in CN2005800022940.
Mexican Office Action (as described by foreign attorney) dated Jun. 18, 2009 issued for MX 06/07950.
Russian Examination and Resolution on Granting Patent dated Jul. 18, 2008 issued in RU 2006-128289-09.
PCT International Search Report dated May 2, 2008 issued in WO 2008/061068.
PCT Written Opinion dated May 2, 2008 issued in WO 2008/061068.
PCT International Preliminary Report on Patentability and Written Opinion dated May 12, 2009 issued in WO 2008/061068.
Australian Examiner's first report dated Jul. 7, 2011 issued in AU 2007319331.
EP Examination Report dated Oct. 28, 2009 issued in EP 07 845 059.0 1238.
PCT International Search Report dated May 20, 2008 issued in WO 2008/063952.
PCT International Search Report and Written Opinion dated May 20, 2008 issued in WO 2008/063952.
PCT International Preliminary Report on Patentability and Written Opinion dated May 19, 2009 issued in WO 2008/063952.
Australian Examiner's first report dated Aug. 2, 2011 issued in AU 2007323945.
European Examination Report dated Oct. 28, 2009 issued in EP 07 864 281.6.
PCT International Search Report dated Dec. 18, 2008 issued in WO 2009/039245.
PCT Written Opinion dated Dec. 18, 2008 issued in WO 2009/039245.
PCT International Preliminary Report on Patentability and Written Opinion dated Mar. 24, 2010 issued in WO 2009/039245.
PCT International Search Report dated May 7, 2008 issued in WO 2008/063914.
PCT Written Opinion dated May 7, 2008 issued in WO 2008/063914.

PCT International Preliminary Examination Report on Patentability and Written Opinion dated May 19, 2009 issued in WO 2008/063914.
Australian Examiner's first report dated Jul. 25, 2011 issued in AU 2007324000.
European Examination Report dated Oct. 28, 2009 issued in EP 07 844 998.0.
PCT International Search Report dated May 14, 2008 issued in WO 2008/063956.
PCT Written Opinion dated May 14, 2008 issued in WO 2008/063956.
PCT International Preliminary Report on Patentability and Written Opinion dated May 19, 2009 issued in WO 2008/063956.
Australian Examiner's First Report dated Aug. 4, 2011 issued in AU 2007323949.
PCT International Preliminary Report on Patentability and Written Opinion dated May 19, 2009 issued in WO 2008/063908.
Australian Examiner's first report dated Jul. 25, 2011 issued in AU 2007323994.
PCT International Search Report dated Jun. 11, 2008 issued in WO 2008/079542.
PCT Written Opinion dated Jun. 11, 2008 issued in WO 2008/079542.
PCT International Preliminary Report on Patentability and Written Opinion dated May 19, 2009 issued in WO 2008/079542.
Australian Examiner's first report dated Aug. 2, 2011 issued in AU 2007338512.
European Examination Report dated Oct. 28, 2009 issued in EP 07 872 343.4.
PCT International Search Report dated May 20, 2008 issued in WO 2008/063971.
PCT Written Opinion dated May 20, 2008 issued in WO 2008/063971.
PCT International Preliminary Report on Patentability and Written Opinion dated May 19, 2009 issued in WO 2008/063971.
Australian Examiner's first report dated Aug. 2, 2011 issued in AU 2007323964.
European Examination Report dated Oct. 28, 2009 issued in EP 07 845 062.4.
PCT International Search Report dated Dec. 11, 2008 issued in WO 2009/039295.
PCT Written Opinion dated Dec. 11, 2008 issued in WO 2009/039295.
PCT International Preliminary Report on Patentability and Written Opinion dated Mar. 24, 2010 issued in WO 2009/039295.
PCT International Search Report dated Jul. 16, 2008 issued in WO2009/054861.
PCT Written Opinion dated Jul. 16, 2008 issued in WO2009/054861.
PCT International Preliminary Report on Patentability and Written Opinion dated Apr. 27, 2010 issued in WO 2009/054861.
Australian Examiner's First Report dated Sep. 22, 2005 issued in AU 29246/02.
Australian Notice of Opposition by Aristocrat Technologies dated Apr. 8, 2009 issued in AU 2007200982.
Australian Statement of Grounds and Particulars in Support of Opposition by Aristocrat Technologies dated Jul. 6, 2009 issued in AU 2007200982.
Australian Withdrawal of Opposition by Aristocrat Technologies dated Aug. 12, 2009 issued in AU 2007200982.
PCT International Search Report and Written Opinion dated May 9, 2008 issued in for WO 2008/048857.
PCT Written Opinion dated May 9, 2008 issued in WO 2008/048857.
PCT International Preliminary Report on Patentability and Written Opinion dated Apr. 15, 2009 issued in WO2008/048857.
Australian Examiner's first report dated Nov. 30, 2011 issued in AU2007312986.
European Examination Report dated Sep. 10, 2009 issued in EP 07 853 965.7.
PCT International Search Report dated May 20, 2008 issued in WO2008/063969.
PCT Written Opinion dated May 20, 2008 issued in WO 2008/063969.
PCT International Preliminary Report on Patentability and Written Opinion dated May 19, 2009 issued in WO 2008/063969.
Australian Examiner's first report dated Aug. 19, 2011 issued in AU2007323962.
PCT International Search Report dated Jul. 21, 2008 issued in WO 2008/063968.
PCT Written Opinion dated Jul. 21, 2008 issued in WO 2008/063968.
PCT International Preliminary Report on Patentability and Written Opinion dated May 19, 2009 issued in WO 2008/063968.
Australian Examiner's first report dated Jul. 29, 2011 issued in AU 2007323961.
European Examination Report dated Oct. 28, 2009 issued in EP 07 854 617.3.
PCT International Search Report dated Jun. 15, 2004 issued in WO 2004/07974.
PCT International Preliminary Report on Patentability and Written Opinion dated Sep. 2, 2005 issued in WO 2004/07974.
Australian Examiner's First Report dated May 17, 2007 issued in AU 2004216952.
Australian Examiner's Report No. 2 dated Jul. 30, 2007 issued in AU 2004216952.
Australian Examiner's Report No. 3 dated May 28, 2008 issued in AU 2004216952.
Japanese Description of Office Action dated Jul. 4, 2006 issued in Application No. 2005-518567.
Japanese Description of Office Action Final dated Apr. 10, 2007 issued in Application No. 2005-518567.
Japanese Description of Office Action (interrogation) dated May 25, 2009 issued by an Appeal Board in Application No. 2005-518567.
GB Combined Search and Examination Report dated Nov. 18, 2011 issued in GB1113207.3.
Australian Examiner's First Report dated Apr. 5, 2005 issued in AU2003227286.
Australian Examination Report (as described by Applicant's Attorney) dated Feb. 26, 2009 issued in AU2003227286.
Australian Re-Examination Report dated May 1, 2009 issued in AU2003227286.
Australian Examiner Communication regarding Claims dated Nov. 24, 2009 issued in AU2003227286.
Australian Notice of Acceptance with Exam Comments dated Jan. 28, 2010 issued in AU2003227286.
Australian Examiner's First Report dated Jul. 23, 2007 issued in AU2006203570.
Australian Notice of Acceptance with Examiner's Comments dated Nov. 15, 2007 issued in AU2006202570.
Australian Re-Examination Report (No. 1) dated Dec. 2, 2009 issued in AU2006203570.
Australian Examiner Communication dated Feb. 5, 2010 issued in AU 2006203570.
Australian Re-Examination Report (No. 2) dated Feb. 8, 2010 issued in AU 2006203570.
Newton, Harry, Newton's Telecom Dictionary, Jan. 1998, Telecom Books and Flatiron Publishing, p. 399.
"Pointer_Ballistics for Windows XP.pdf" (Oct. 31, 2002), Microsoft,[downloaded on Aug. 27, 2010 from http://www.microsoft.com/whdc/archive/pointer-bal.mspx], 3 pages.
Police 911, Wikipedia, Jan. 22, 2002, retrieved from Internet at http://en.wilkipedia.org/widi/Police_911 on Oct. 28, 2007, 4 pgs.
Stic Search History, Patent Literature Bibliographic Databases, in a US Office Action dated Jul. 23, 2010 issued in U.S. Appl. No. 11/938,151, 98 pages.

* cited by examiner

SIMULATED REEL IMPERFECTIONS

CROSS REFERENCE TO RELATED APPLICATIONS

This application claims priority under 35 U.S.C. §119(e) to U.S. Provisional Patent Application No. 60/858,741 filed on Nov. 13, 2006, which is incorporated herein by reference in its entirety for all purposes.

FIELD OF THE INVENTION

This invention relates to gaming machines. In particular, embodiments described herein relate to video data, for output on a gaming machine, that simulates visible imperfections commonly seen in a mechanically driven reel slot machine.

BACKGROUND

As technology in the gaming industry progresses, the traditional mechanically driven reel slot machines are being replaced by electronic machines having LCD video displays or the like. Processor-based gaming machines are becoming the norm. Part of the reason for their increased popularity is the nearly endless variety of games that can be implemented using processor-based technology. These gaming advancements enable the operation of more complex graphics and games, including video clips from movies and bonus games with custom animation, which would not possible on mechanical-driven gaming machines. The increasing cost of designing, manufacturing, and maintaining complex mechanical gaming machines has also motivated the casinos and gaming industry toward video-based replacements.

OVERVIEW

The present invention provides a gaming machine configured to output video data that simulates mechanical reels in a traditional mechanical slot machine. Embodiments described herein contribute to the emulation of a mechanical machine by simulating one or more visible mechanical imperfections commonly found in a mechanical reel machine.

In one aspect, the present invention relates to a gaming machine. The gaming machine includes a display device and a cabinet defining an interior region of the gaming machine. The cabinet is adapted to house a plurality of gaming machine components within or about the interior region. The display device is disposed within or about the interior region and configured to output a visual image in response to a control signal. The gaming machine includes at least one processor configured to execute instructions, from memory, that: a) permit game play, on the gaming machine and using the display device, of a game of chance with multiple video reels displayed by the display device; and b) display video data, on the display device, that includes one or more simulated visible mechanical imperfections of a mechanical reel in a gaming machine.

In another aspect, the present invention relates to a gaming machine with layered displays. The gaming machine includes a first display device, disposed within or about the interior region, that is configured to output a visual image in response to a control signal and includes one or more controllably transparent portions. The gaming machine also includes a second display device, arranged relative to the first display device such that a common line of sight passes through a portion of the first display device to a portion of the second display device, and arranged inside the first display device.

The gaming machine further includes at least one processor configured to execute instructions, from memory, that: a) permit game play, on the gaming machine and using the second display device, of a game of chance with multiple video reels displayed by the second display device, and b) display video data, on the second display device, that includes one or more simulated visible mechanical imperfections of a mechanical reel in a gaming machine.

In yet another aspect, the present invention relates to a method of providing a game of chance on a gaming machine, the method includes displaying the game of chance on a video display device included in the gaming machine, wherein the game of chance includes a set of video reels. The method also includes, during the game, simulating the movement of symbols on each video reel in the set of video reels on the display device. The method further includes, for one or more of the video reels in the set of video reels, displaying video data, on the display device, that simulates one or more visible mechanical imperfections of a mechanical reel in a gaming machine.

In another embodiment, the present invention relates to logic encoded in one or more tangible media for execution and, when executed, operable to provide a game of chance on a gaming machine.

These and other features and advantages of the invention will be described in more detail below with reference to the associated figures.

DESCRIPTION OF THE PREFERRED EMBODIMENTS

Figure 1:
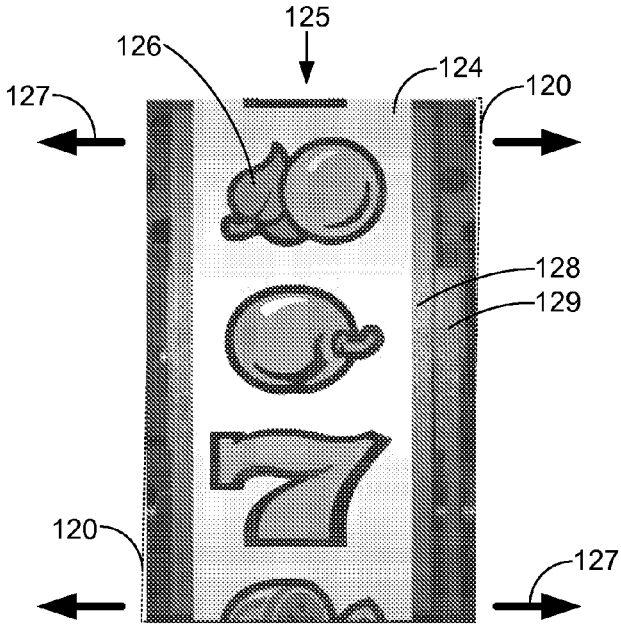
FIG. 1 shows simulated jitter of a video reel in accordance with one embodiment.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Gaming machine manufacturers highly regard customer preference information. When the assignee introduced CRT-based slot machines in 1975, the reaction of some players was less than enthusiastic. The CRT screens jolted players from a gaming activity based on a complex mechanical apparatus to a single, flat, video screen. The technology of 1975 pales in comparison to that of today. And yet, amongst casino patrons and other players, the perceived value of mechanically driven reel slot machines remains high.

Customer preference information belonging to the assignee shows that players trust the old mechanical machines. Some players feel that a lack of mechanically driven reels causes a slot game to be cheapened—and somehow less random. Many players believe that it is impossible to externally tamper with or (to player detriment) control outcomes for a mechanically driven machine. These people also commonly believe that manipulating outcomes portrayed on a video screen is both easily accomplished and undetectable to a player. A loyal base of players still favors the traditional mechanical stepper machines, even today.

The gradual disappearance of mechanical gaming machines, however, has left admirers of mechanical steppers scrambling to find their preferred machines.

Described herein are processor-based gaming machines that realistically emulate a mechanical reel machine. The gaming machine includes a number of adaptations, such as audio, video and/or physical adaptations, where each contributes to the perception of a mechanically driven reel slot machine. Specific embodiments described herein provide video data, for output on a video display device, that simulates visible mechanical imperfections of a mechanical reel in a gaming machine. Several of these visible mechanical imperfections and simulations are described in further detail below with respect to FIGS. 1-3.

Before describing these embodiments, it is useful to differentiate between three types of reels in a gaming machine: mechanical reels, two-dimensional (2-D) video reels, and realistic video simulation of mechanical reels as described herein.

Mechanical reels refer to the traditional hardware reels, with their associated latches and various mechanical parts. A mechanical reel usually has a set number of symbols disposed about a circumference of a reel strip attached to a wheel. A motor, spring, or other mechanical system physically spins the wheel until it stops at a rotational position and a particular symbol rests in view of a player to indicate an outcome for the reel game. In many older machines, the reels and symbols were spun by potential energy first stored in a spring-loaded mechanism wound and then actuated by the pull of a traditional pull-arm handle. Each reel was stopped at a random position by a mechanical device. The gaming machine senses an outcome, along a central payline, by sensing the position of each reel.

2-D video reels refer to the use of cartoonish animations that caricature reels in a single 2-D video device. The cartoonish animations do not intend to realistically portray actual mechanical reels, nor do they.

Realistic video simulation of mechanical reels, using embodiments described herein, refers to 2-D and/or 3-D hardware and/or software attempts to emulate actual mechanical reels. Their goal is to have a player perceive a real mechanical reel, at least partially. In particular, embodiments described herein contribute to the perception of a mechanically driven reel slot machine by simulating visible mechanical imperfections in a mechanical machine. Other video adaptations that emulate actual mechanical reels are also suitable for use. Briefly, these other video adaptations may include: outward bowing of video reel edges to simulate the curvature of an actual circular mechanical reel, variable fore-lighting of video reel displays to simulate real reel curvature and out of plane perception, backlight blinking of video reel symbols to simulate lighting used in mechanical systems, etc. Other video adaptations are also suitable for use.

The embodiments described herein use video to simulate one theme of real mechanical reels in a gaming machine: their imperfections. Old mechanical reel-based gaming machines have numerous mechanical imperfections, and many of these imperfections are visibly perceivable. As the inventor discovered, these imperfections can be leveraged by a digital-based machine to add to the realism perceived by a person who is near a processor-based machine.

Traditional mechanical reels move imperfectly. Rather than diminishing user experience, however, the quirky and imperfect nature of these machines quickly became one of their most desirable and endearing characteristics. The perceived mechanical imperfections often differed between machines; frequent players would often associate a personality with each machine based on its imperfections. Given each machine's unique personality, frequent players felt they could 'pick winning machines' because they could intuitively sense differences between the machines. The players would often select a machine that 'felt lucky' to them—or a machine that was 'hot'. Also, the perceivable mechanical imperfections and visible variations in physical performance reinforced a notion in the minds of players that the gaming outcomes were truly random events—derived from an imperfect machine that could not be controlled or manipulated to their detriment. Many people trusted the old mechanical slot machines more. The resultant player loyalty has helped the mechanical machines persist in the gaming industry, despite their cost disadvantages relative to processor-based machines.

FIGS. 1-3, 5A and 5B describe embodiments that include video data configured to simulate visible mechanical imperfections of a mechanical reel in a gaming machine.

In addition to video adaptations, a gaming machine as described herein attempting to emulate a mechanically driven reel slot machine may also include contributions from other sources. The gaming machine may include a combination of audio, video and/or physical adaptations.

Audio adaptations may include: stereo audio that varies output audio based on video reel position in the gaming machine (e.g., audio for a left video reel is output and increasingly heard on a left side of a digital machine, while audio for a right video reel is increasingly heard on the right side of the machine), stereo recording and playback of actual mechanical sounds in a real mechanical reel machine, randomization of the actual mechanical sounds to avoid repetition of the same sounds, etc. Other audio adaptations are also suitable for use.

Physical adaptations may include the use of layered video displays with a set distance between the displays. Traditional mechanical reel gaming machines arranged the mechanical reels behind a glass layer. The glass layer was arranged proximate to a player standing in front of the machine and included screen printing or printed decals attached to the glass. The printing indicated rules for the game, pay tables, and various game graphics. In this multiple video display embodiment, a proximate display device, such as an LCD, includes video data that mimics the glass layer and information typically printed on the glass layer. To increase realism, the video information may also include glare lines and other depictions of interaction of the stickers with an environment around a gaming machine. Video data for stickers may also include video fraying and video discoloration (e.g., dirt that simulates age) to add the realistic simulation of aged and actual stickers. A second display device, behind the first, which may also be an LCD, then includes video data that simulates the mechanical reels. Physical separation of the two video displays mimics the same separation seen between the glass and reels in a tradition mechanical gaming machines, and significantly adds to the illusion of a real mechanical system. FIGS. 4-5 describe the use of layered video displays to simulate this mechanical arrangement. Other physical adaptations may be used.

Individually, each of these audio, video and physical adaptations may not create a full illusion of a mechanical reel machine. Cumulatively, however, when multiple of these adaptations are provided in a processor-based gaming machine, senses for a person near the gaming machine process numerous indications of a real mechanical reel machine, and the person may be at least partially or temporarily fooled into perceiving a real mechanical reel machine.

While digital simulation as described herein is not an exact replacement for a truly mechanical machine, it is believed to be a reasonable match that preserves some or most of the "look and feel" of mechanical reel-based machines. These digital machines may satisfy many players looking for a mechanical reel-based machine, while avoiding the associated costs and complexities of old mechanical machines, and permitting the benefits of digital machines. For example, processor-based display devices permit easy reconfiguration of video output, including remote reconfiguration. The digital nature of the video display devices permits the reel game on a gaming machine to be changed using digital techniques. This allows symbols on the video reels to be changed to present a different reel game, if desired. Or this also allows the number of reels output by the video display devices to change. Wireless or wired connection to the gaming machine also permits remote changes to games by downloading instructions for the changes to the gaming machine.

As the term is used herein, a visible mechanical imperfection of a mechanical reel refers to visible actions, attributes or behavior of a mechanical reel or one or more parts in a mechanical reel or gaming machine. In one embodiment, the visible mechanical imperfection is dynamic, meaning that the mechanical reel is moving when it displays the visible imperfection. Genesis of visible imperfections often stems from peculiarities, realities or imperfections in the mechanical device or system, such as loose machining tolerances, random variation of real systems, etc. Causes and consequences of some of these visible mechanical imperfections are described in further detail below for each embodiment before the corresponding video simulation is shown and described. In a specific embodiment, a gaming machine uses as many of the mechanical imperfections provided below as possible. This improves the perception of realism for a user.

For example, while manufacturers over the years attempted to perfect the rotational motion of the reels, limitations of the mechanical apparatus always resulted in some degree of visual imperfection. Spinning reels would "wobble" or "jitter" slightly due to minute variations in the circularity of the reels, non-perfect alignment of the reel strips around the entire circumference of adjacent reels, uneven distribution of mass about the axis of rotation, or combinations of these and other imperfections. Slightly uneven application of the symbol strip to the reel framework often caused edges of a strip and the symbols printed thereon to appear to oscillate from side to side as the reel spun.

FIG. 1 shows a simulated visible mechanical imperfection in accordance with one embodiment. Specifically, FIG. 1 shows jitter 120 of a video reel 125. While the present invention will now be shown as graphics for display on a video device, those of skill in the art will appreciate that the following discussion and Figures also refer to methods and systems for providing a game of chance and providing video data on a gaming machine.

Simulated jitter 120, or wobble, of reel 125 refers to the simulation of shaking and other small movements a real mechanical reel as it spins. As described above, in a real mechanical reel, jitter is attributable to mechanical imperfections in the reel-based mechanism or slightly uneven application of the symbol strip to the reel framework. Realistic reel jitter typically moves a reel apart from the direction of rotation, e.g., horizontally if the direction is vertical. Simulated jitter 120 may be produced in video by slightly displacing an image of a simulated video symbol-laden reel 125, or a portion thereof. As shown, simulated video reel 125 rotates slightly clockwise to simulate this effect, as shown by the outline 120. In general, the displacement may include a translation, rotation, or combinations thereof. Arrows 127 in FIG. 1 show permissible translations of simulated jitter. In a specific embodiment, the jitter includes a lateral translation of the entire reel 125. In another specific embodiment, a portion of reel 125 jitters. The portion may include a reel strip 124 and its symbols 126, for example, when the video simulation does not include video simulation of the mechanical wheel 128 and other parts such as the internal bore 129 (or in a direction substantially normal to its spinning direction).

The degree of simulated jitter 120 approximates that of a real reel. As one with skill in the art will appreciate, the amount of jitter 120 may vary with size and resolution of the video device displaying the video, size of reel 125, the degree to which a designer wants to show it, etc. In a specific embodiment, simulated jitter 120 includes pixel displacements of pixels in reel 125, or a portion thereof, from 1 pixel to about 10 pixels on a display device with medium to high resolution (e.g., above 1024 by 768 resolution). In a specific embodiment, the lateral displacement is about 2 pixels or less. In another specific embodiment, the simulated video reel 125 shakes horizontally in a video display by one pixel left and right.

A variety of features may be used in modeling and simulating visible mechanical imperfections of a mechanical reel. One noteworthy mechanical dynamic that often affects the mechanical imperfections and corresponding simulation is the speed of reel rotation. In many old mechanical reel gaming machines, the energy to spin the reels came entirely from a player pull on a handle. This energy, usually stored in a spring of some design as potential energy, was then imparted to the reels, causing them to spin. In general, the larger the reel, the slower it would spin for a given input energy. Large reel simulations spinning too quickly or small reels spinning too slowly may detract from accurately simulating a reel. Thus, a larger simulated reel may be spun more slowly than a smaller reel. Visually, appearance of the reel symbols primarily conveys rotational velocity for a spinning reel. On a mechanical machine, the reel symbols are typically perceived as a blur. In a specific embodiment to convey rotational motion of the symbols, the simulated symbols are rapidly swept across a video display device. This may use a video refresh rate above 24 frames per second to prevent perception of video artifacts based on human visual perception refresh rates.

In another specific embodiment, the simulated video of reels replaces discrete symbols on a reel with an animation of a pre-blurred image. This pre-distortion of the symbols 126 makes it more difficult for a person to detect static attributes of each symbol 126 as they spin by, thereby reducing a reliance on display device refresh rate. The degree of blurring largely controls the perception of rotational velocity. Less blurring of symbols 126 in the direction of rotation portrays a slower reel, while increased blurring of symbols 126 conveys a greater velocity. Complete obscuration of symbols 126 conveys a much greater velocity. The blurring may be accomplished either by replacing the symbols with an animation of blurred images spinning, or by individual blurred images actually moving across the display device. Blurring may also extend to spaces between adjacent symbols to reduce the size of white space between moving symbols, which can result in flashing and reduce the perception of true rotation.

In practice, a designer assigns a speed to reel 125 and simulated symbols 126. The speed refers to a simulated reel velocity for the symbols on a mechanical reel. The speed may be altered based on the simulated reel size, along with other factors.

Simulated reel speed may also affect jitter 120. For example, output video jitter 120 may be related to the simulated speed of rotation of reel 125. In a specific embodiment, lateral displacement jitter 120 is implemented relative to simulated reel speed of rotation of reel 125 on a periodic basis. In this case, cyclic displacement is linked to periodic rotation of reel 125 so that specific reel locations are displaced similarly or identically upon each rotation of reel 125. This effect simulates a real mechanical reel where the reel strip is unevenly installed and/or a reel that is geometrically or materially imperfect. In another specific embodiment, lateral displacement jitter 120 is implemented relative to simulated reel speed of rotation of reel 125 on a random basis. This simulates a mechanical reel that wobbles slightly as it rotates upon its axis, perhaps due to a mismatch between an axis for the reel and the reel bearings. This random displacement often becomes increasingly noticeable on a mechanical machine as component wear increases.

Another mechanical modeling technique may include translating performance of a handle, associated with a gaming machine, to the simulated video reels. In many old mechanical reel gaming machines, a longer handle provided greater mechanical advantage to wind a spring that spun the reels. Players would also pull a handle variably to perceivably affect reel outcome (regardless of whether it actually did). In one embodiment, handle feedback is used in part to determine rotational speed of a simulated mechanical reel 125. This may then affect video output of jitter 120. In a specific embodiment, a handle, provided with a gaming machine, includes a force sensor that is configured to output an indication of force that a person used when pulling the handle. Rotational speed for simulated mechanical reel 125 then relates to the detected force.

Another simulated visible mechanical imperfection is 'reel kickback'. Reel kickback refers to the dynamic bounce or motion of a reel that is produced when stopped. Theoretically, a wheel stopping mechanism halts wheel motion instantaneously at a specific position. Realistically, this instantaneous stoppage does not occur. Reels on old gaming machines were often stopped by a latching mechanism. As each reel latched into its final resting position, the latching mechanism absorbed the rotational kinetic energy in the reel, and stored a portion of this energy as the reel stopped. The stored potential energy would cause "kick-back": in the instant just before a reel completely stops, a small amount of reverse rotation (in a direction opposite to reel spinning) can be observed during the stopping and settling process.

Figure 2:
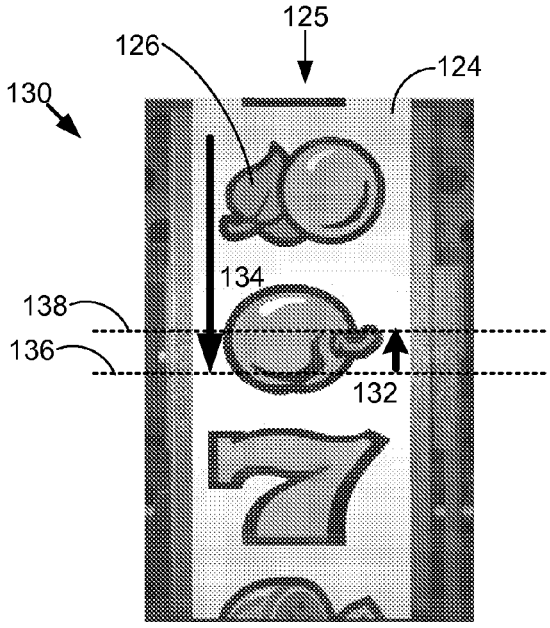
FIG. 2 shows simulated reel kick-back of a video reel in accordance with another embodiment.

FIG. 2 shows simulated reel kick-back 130 of a video reel 125 in accordance with another embodiment.

Kick-back 130 includes a small amount of counter-rotation 132, which includes motion from an initially intended stopping position 136 for reel 125 to a final stopping position 138. Kick-back 130 is thus added to the graphical animation of spinning reel 125 after the reel ceases its spinning in a primary direction 134 of spin. Counter-rotation 132 includes motion in a direction opposite to the primary direction 134 of spin for reel 125. Thus, if a video reel 125 is spinning downward 134, kick-back 130 includes a small amount of upward 132 simulated wheel rotation.

Reference lines for stopping position 136 and final stopping position 138 indicates reel kick-back 130 and the amount of counter-rotation 132. Stopping position 136 refers to a wheel position where rotation in the primary direction stops, and turns into counter-rotation 132; final stopping position 138 refers to a wheel position in which counter-rotation 132 stops and reel 125 finally stops moving.

In general, the amount of counter-rotation 132 may include any video motion that induces a perceived sense of realism by a player. Kickback 130 may vary with the size of a video display area, a size for reel 125, an amount of motion the designer wants, combinations thereof, etc. Different gaming machines and reel mechanisms will exhibit varied performance, so the amount of counter-rotation 132 may be determined empirically by comparison to a specific gaming machine or mechanism. Larger machines and reels will typically exhibit greater counter-rotation. Kick-back 130 and counter-rotation 132 may be measured as a percentage of reel 125 size. In a specific embodiment, counter-rotation 132 from reference line 136 was less than about 5% of the visible height of reel 125. Kick-back 130 may also be measured in pixels. A counter-rotation 132 from about 1 pixel to about 10 pixels is suitable for many display devices. Kick-back 130 may also be implemented as a percentage size of a video screen that displays reels 125. In a more specific embodiment, the symbols 126 on reel 125 bounce back from reference line 136 less than 0.5% of the screen height for a display device. For a display device with a 1080 vertical resolution, a kickback between about 0.3% and about 0.5% of the screen height is suitable. This allows the kick-back 130 to vary with the dimensions of a display device. This screen height scaling may result in a non-whole number of pixels for kick-back 130. Fractions may be rounded up or down or ignored as desired.

This kick-back phenomenon also often appears in a real mechanical reel just before rotation begins. In particular, reels in older mechanical reel machines often displayed a slight amount of reverse rotation, typically seen just before they started spinning. Mechanically, this was often caused by a spring actuator being wound by a handle pull that engaged the mechanical reels.

FIG. 2 can also be used to show simulated pre-spinning kick-back 130 of a video reel 125 before simulated spinning begins in accordance with another specific embodiment. Again, counter-rotation 132 for pre-spinning kick-back 130 includes motion in a direction 132 opposite to the primary direction 134 of spin for reel 125.

The amount of pre-spinning counter-rotation 132 may include any motion that induces a sense of realism in perception by a player. Similarly, pre-spinning kickback 130 may vary with the size of a video display area, a size for reel 125, an amount of motion the designer wants, etc. It may also be determined empirically. In a specific embodiment, pre-spinning counter-rotation 132 from reference line 136 was less than about 0.5 percent of the visible height of reel 125. A range of pre-spinning counter-rotation 132 displacements from about 1 pixel to about 5 pixels is suitable for many display devices. In a more specific embodiment, the symbols 126 on reel 125 pull back from reference line 136 less than 0.5% of the screen height for a display device.

Another visible mechanical imperfection in real reel gaming machines is varying rotational speed between adjacent reels. This slight speed variation may be due to minor machining tolerances in actuators for the reels, for example.

Figure 3:
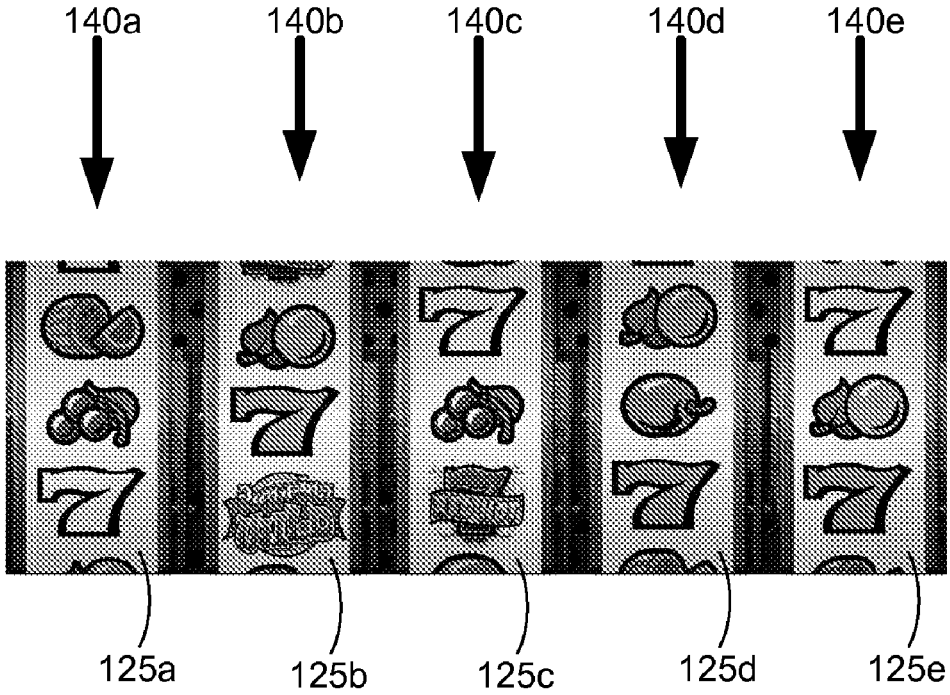
FIG. 3 shows video for five reels with different speeds in accordance with another embodiment.

FIG. 3 shows video for five reels 125*a*-125*e* with different speeds 140*a*-140*e* in accordance with another embodiment. The magnitude of arrows 140*a*-*e* indicates the respective speed of each reel 125.

The speed difference between reels 125*a*-125*e* is typically minor. In a specific embodiment, the speed varies between reels by less than about 15 percent of the maximum speed for a video reel in a set of reels.

Another difference between video animations and real mechanical systems is randomness. Video animations display exactly as they are programmed, which usually means displaying the same each time they are called. For a gaming machine where a player can play dozens or hundreds of times, this repeatability can be readily seen. Most mechanical reel systems, however, are subject to some degree of variation between successive spins. In a specific embodiment, realistic simulation applies randomness to video output to further add to simulated imperfection. Indeed, all of the above-mentioned mechanical imperfections and embodiments may exhibit and add a degree of randomness in the short term. For example, in reality, the degree of kick-back depends in part upon rotational speed of a reel and how closely the reel latch was to the centered resting position upon actuation. Thus, a random factor may be added to kickback 130 of FIG. 2. The random factor varies the amount of counter-rotation 132 by a small amount that resembles random disturbances. In a specific embodiment, the counter-rotation 132 by about 10 percent to about 25 percent of counter-rotation 132. Other random factors are also suitable for use. Over the longer term (e.g., years), normal wear of moving parts within the machine also often increases the magnitude and randomness of these unintended mechanical imperfections and effects. For example, the amount of jitter 120 may vary between processor-based gaming machines to let players perceive there are visible differences between the machines.

In one embodiment, the video reels and one or more simulated mechanical imperfections are output on a gaming machine having a single display device that outputs video information for a game. As the term is used herein, a display device refers to any device configured to output a visual image in response to a control signal. In one embodiment, the display device includes a screen of a finite thickness, also referred to herein as a display screen. For example, LCD display devices often include a flat panel that includes a series of layers, one of which includes a layer of pixilated light transmission elements for selectively filtering red, green and blue data from a white light source. Each display device is adapted to receive signals from a processor, video processor or controller included in the gaming machine and to generate and display graphics and images to a person near the gaming machine. The format of the signal will depend on the device. In one embodiment, all the display devices in a layered arrangement respond to digital signals. For example, the red, green and blue pixilated light transmission elements for an LCD device typically respond to digital control signals to generate colored light, as desired.

In another embodiment, the gaming machine includes multiple display devices arranged in a common line of sight relative to a person near the gaming machine. Multiple display devices disposed along a common line of sight are referred to herein as 'layered' displays. In one embodiment, the gaming machine includes two display devices, including a first, foremost or exterior display device and a second, underlying or interior display device. For example, the exterior display device may include a transparent LCD panel while the interior display device includes a second LCD panel.

Figure 4A:
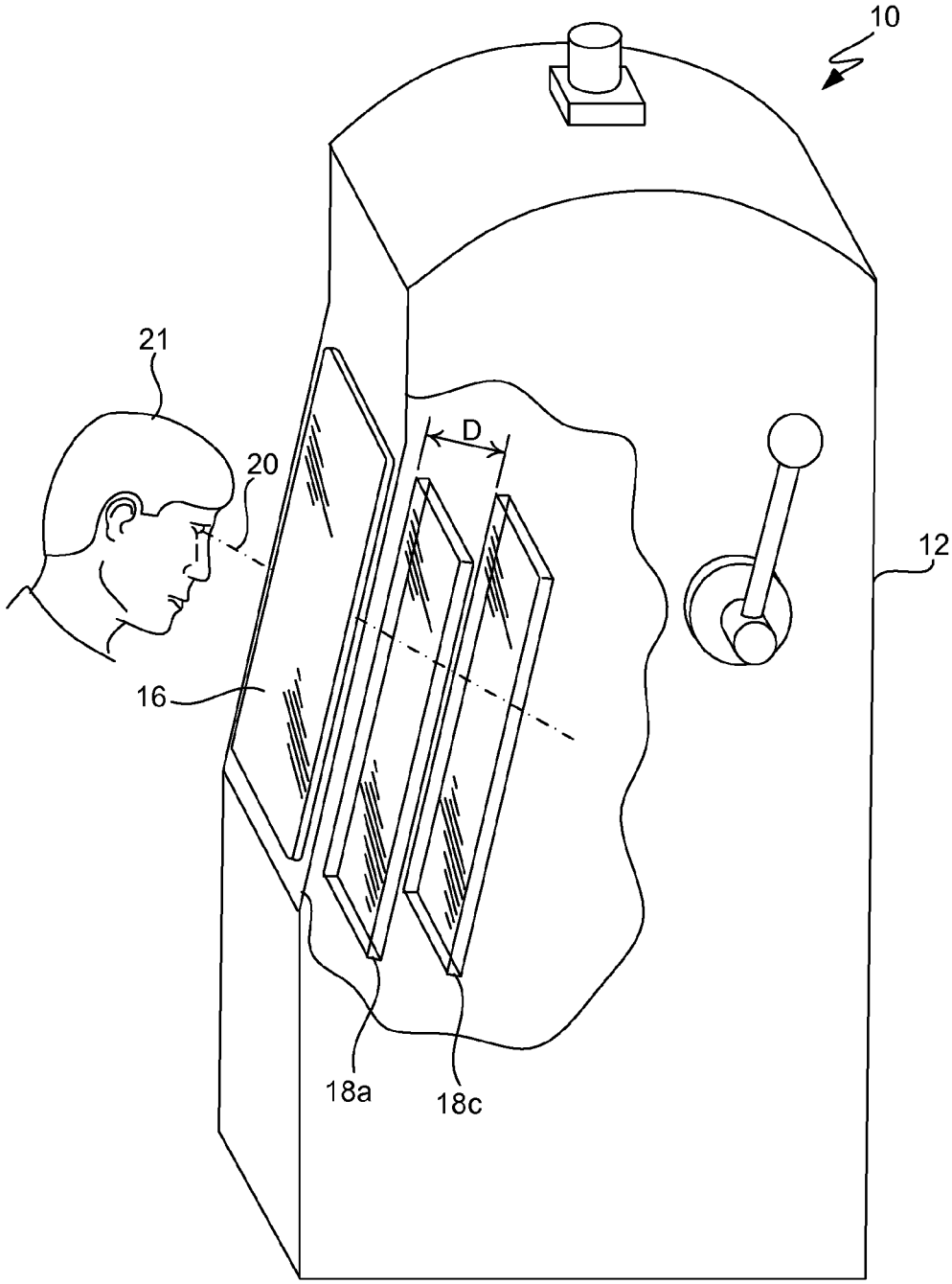
FIG. 4A shows layered displays in a gaming machine in accordance with one embodiment.
Figure 4B:
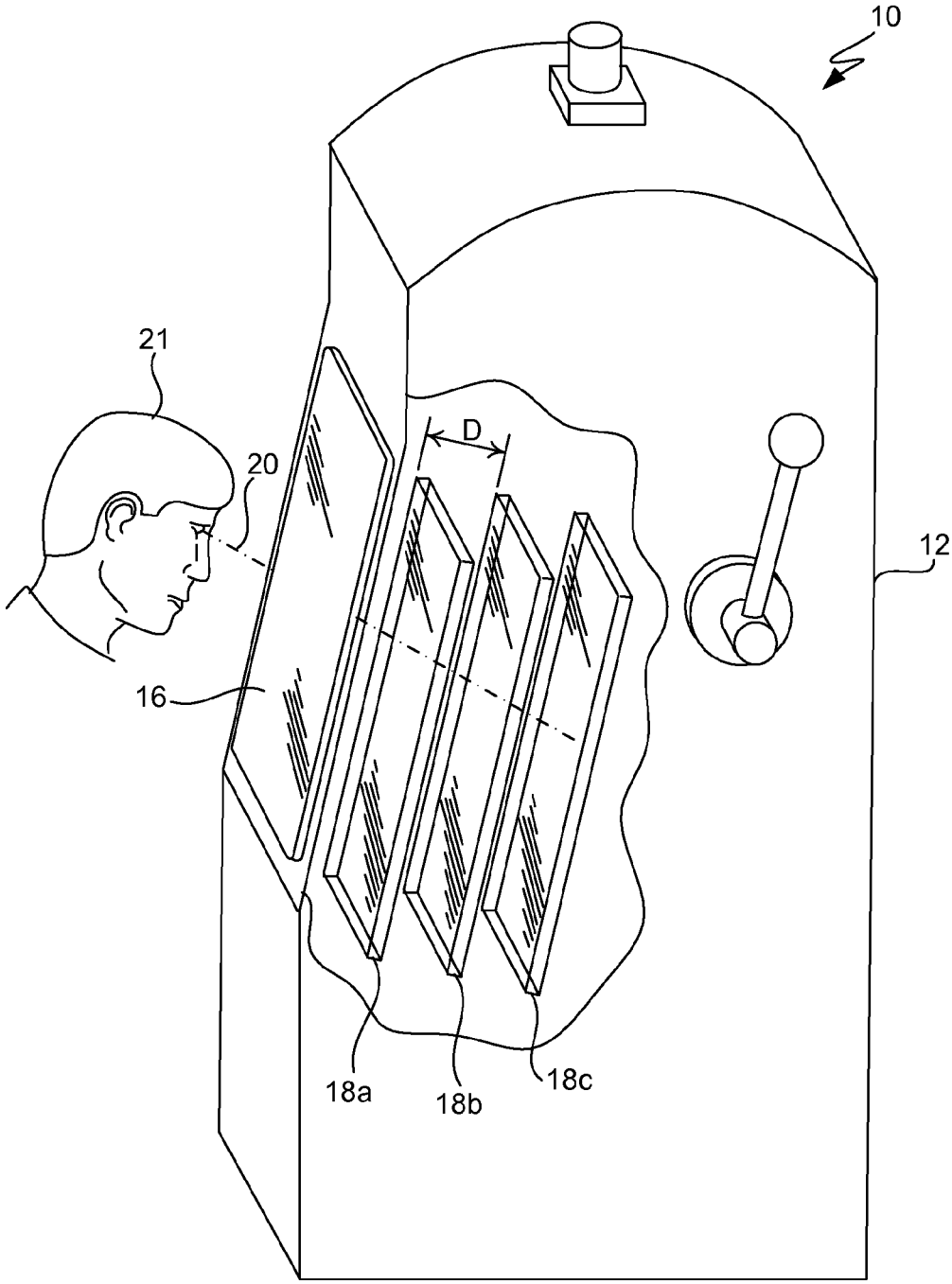
FIG. 4B shows layered displays in a gaming machine in accordance with another embodiment.

Referring primarily now to FIGS. 4A and 4B, a gaming machine 10 of a specific embodiment with layered displays includes a cabinet or housing 12 that houses exterior display device 18*a*, intermediate display device 18*b* (FIG. 4B only), interior display device 18*c* and a touchscreen 16.

Layered display devices may be described according to their position along a common line of sight relative to a viewer. As the terms are used herein, 'proximate' refers to a display device that is closer to a person, along a common line of sight (such as 20 in FIG. 4A), than another display device. Conversely, 'distal' refers to a display device that is farther from a person, along the common line of sight, than another. While the layered displays of FIGS. 4A and 4B are shown set back from touchscreen 16; this is for illustrative purposes and the exterior display device 18*a* may be closer to touchscreen 16.

Figure 5A:
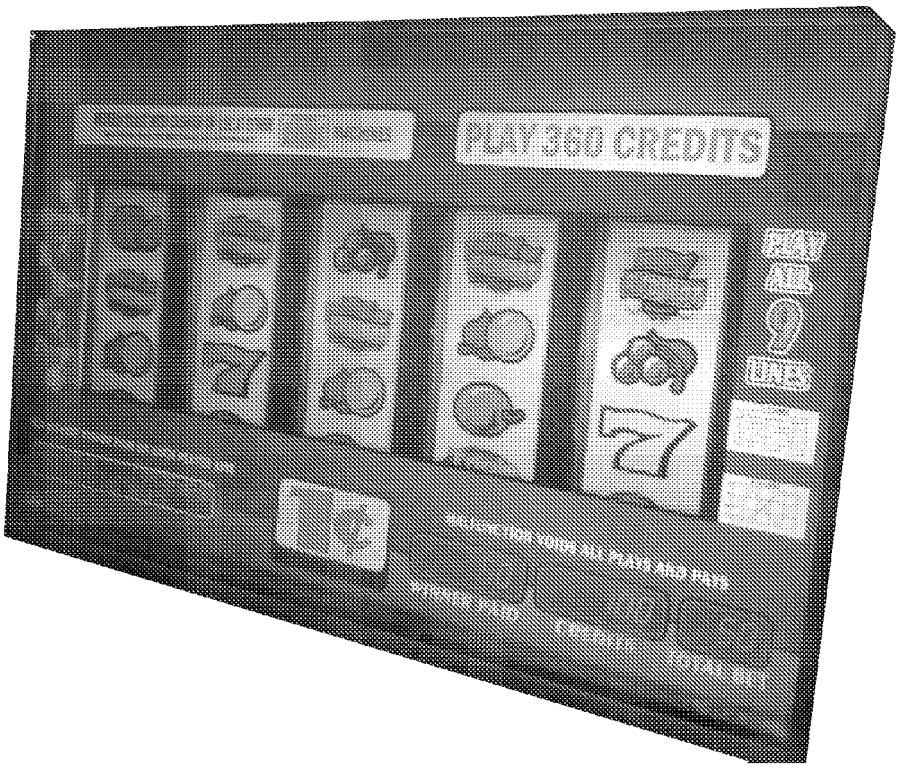
FIG. 5A shows video output on layered displays and configured to realistically simulate mechanical reels in accordance with one embodiment.
Figure 5B:
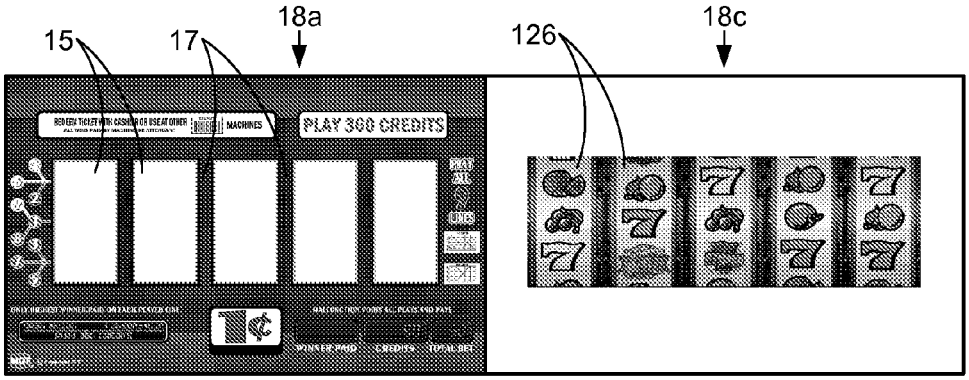
FIG. 5B shows the video output of FIG. 5A separated into front and back video for display on front and back displays, respectively, in accordance with one embodiment.

These layered display devices are well suited to output video data that simulates a mechanical reel game. FIG. 5A shows video output on layered displays and configured to realistically simulate mechanical reels in accordance with one embodiment. FIG. 5B shows the video output of FIG. 5A separated into front and back video output, and for provision to front and back layered displays, in accordance with one embodiment.

As shown in FIG. 5A, the layered displays are configured to resemble a traditional mechanical slot machine—both a) spatially and b) using video provided to each display device 18*a* and 18*c*. In this case, as shown in FIG. 5B, front display device 18*a* outputs silkscreen video data that resembles a silk-screened glass, while rear display device 18*c* includes five reels 125 that simulate and resemble traditional mechanical reels. Reels 125 "spin" during game play on gaming machine 10.

Exterior display device 18*a* includes central portions that are transparent to permit viewing of the virtual slot reels that are shown on the distal display device 18*c*. Other peripheral portions of the exterior display device 18*a* show a pay table, credit information, and other game relevant information, such as whether a bonus game or progressive game is available. Unlike a traditional mechanical machine where the silk-screened information is relatively permanent, this game relevant information may be changed by simply changing the video data provided to display device 18*c*.

FIGS. 4A and 4B illustrate the spatial distance between display devices 18. In one embodiment, a predetermined distance "D" separates the display screens for the multiple display devices. As shown in FIG. 4A or 4B, the predetermined distance, D, represents the distance from the display surface of display device 18*a* to display surface of display device 18*b* (FIG. 4B) or display device 18*c* (FIG. 4A). This distance may be adapted as desired by a gaming machine manufacturer. In one embodiment, the display screens are positioned adjacent to each other such that only a thickness of the display screens separates the display surfaces. In this case, the distance D depends on the thickness of the exterior display screen. In a specific embodiment, distance "D" is selected to minimize spatial perception of interference patterns between the screens.

This improves perception of a three-dimensional device. Spatially separating the devices 18*a* and 18*c* allows a person to perceive actual depth between video output on display device 18*a* and video output on display device 18*c*. The output of FIG. 5A shows a silkscreen that is physically separated from the reels, which emulates a real mechanical reel machine. This depth perception is as real for video devices 18 as it is for a traditional mechanically driven reel slot machine.

Bars 17 (FIG. 5B) add to the depth perception. More specifically, the bars 17 permit a person 21 to vary what portions of display device 18*c* that they see behind the bars on display device 18*c*-based on their current position and viewing angle. Thus, when a person moves relative to bars 17 and gaming machine 10, the lines of sight 20 though portions window change, which changes the portions of display device 18*c* (FIG. 18*c*) that are visible. This grants true three-dimensional depth perception, where objects in a background change in visibility based on position and perspective. Again, this helps gaming machine 10 emulate a traditional mechanically driven reel slot machine.

The video displays, however, permit digital output and all its benefits. For example, the digital domain permits external loading and changing of simulated reel games. This permits a casino or gaming establishment to change video on each of the layered display devices, and their transparency, without physically altering the gaming machine or requiring maintenance. Thus, the number of virtual slot reels 125 may be changed from 3 to 5 to 9, or some other number. In this case, the intermediate and exterior display devices change the position of their transparent window portions 15 for viewing of the different number of virtual slot reels. Symbols on each virtual slot reel 125 may also be changed. Also, a pay table shown on display device 18*a* may be changed at will, in addition to changing whether a bonus or progressive game is shown on the intermediate display device. This permits the same gaming machine to play new games simply by downloading a data onto the machine. For a mechanical machine, this game change traditionally required manual and mechanical reconfiguration of a gaming machine, e.g., to change the number of reels for new reel game that requires five reels instead of three.

Figure 7:
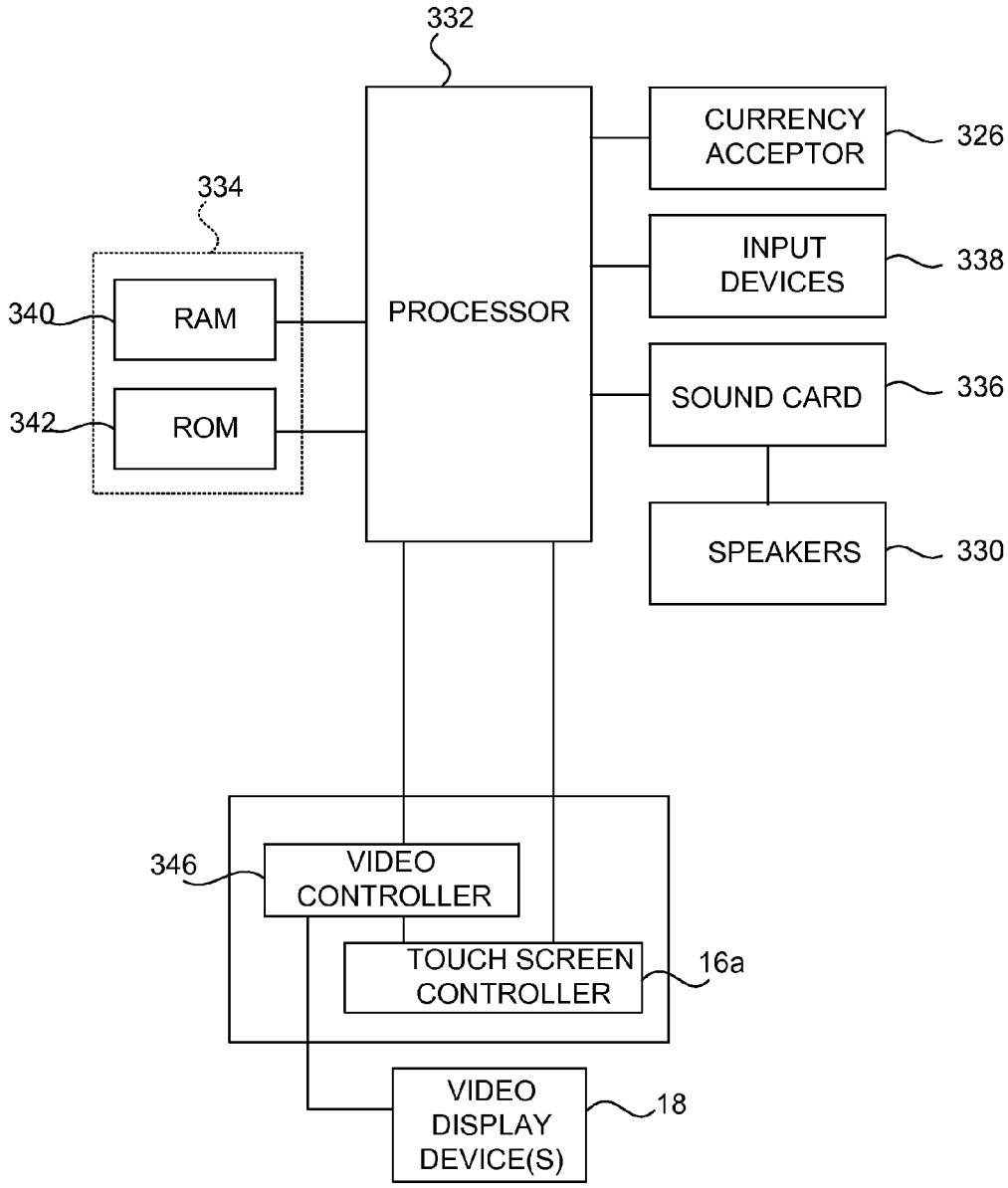
FIG. 7 illustrates a control configuration for use in a gaming machine in accordance with another specific embodiment.

Referring to FIGS. 4A, 4B and 7, layered displays and their operation will be further described. Processor 332 controls the operation of components in gaming machine 10 to present one or more games, receive player inputs using the touchscreen 16, and control other gaming interactions between the gaming machine and a person 21. Under the control of processor 332, display devices 18 generate visual information for game play by a person 21. As shown in FIG. 4A, there are two layered display devices 18: a first, exterior or frontmost display device 18*a*, and a backmost display screen 18*c*. As shown in FIG. 4B, there are three layered display devices 18: frontmost display device 18*a*, a second or intermediate display device 18*b*, and a backmost display screen 18*c*. The display devices 18*a*, 18*b* and 18*c* are mounted and oriented within the cabinet 12 in such a manner that a straight and common line of sight 20 intersects the display screens of all three display devices 18*a*, 18*b* and 18*c*. In addition, display devices 18*a*, 18*b* and 18*c* are all relatively flat and aligned about in parallel to provide a plurality of common lines of sight that intersect screens for all three.

The gaming machine may also include one or more light sources. In one embodiment, display devices 18 include LCD panels and at least one light source that provides light, such as white light, to the pixilated filter elements on each LCD panel. For example, a back lighting source (not shown) may be positioned behind display device 18*c*. The pixilated panel for each parallel display device 18*a*, 18*b* and 18*c* then filters white light from the backmost backlight to controllably output color images on each screen.

Other light sources may be used to illuminate a reflective or transmissive light filter. For example, each display device 18 may be individually illuminated using a white light source attached near the sides (top, bottom, left, and/or right) of each pixelating panel; the side light source may include a mini-fluorescence source and light guide that transmits light from the side light source, down the flat panel, and to all the pixilated filter elements in the planar LCD panel for pixilated image production. Other suitable light sources may include cold cathode fluorescent light sources (CCFLs) and/or light emitting diodes, for example.

In another embodiment, a distal and emissive display device is arranged behind a proximate and non-emissive display device, and provides light to the proximate display device, which then filters the light to create an image. For example, a flat OLED or plasma display device 18*c* may be used to a) produce an image and b) to emit light that is filtered by LCD panels 18*a* and 18*b*. In this case, the distal and emissive display device emits at least some white light. For example, video output of one or more reels may include significant white light that is also used to illuminate one or more LCD panels for pixilated filtering. In another embodiment, the proximate LCD panels use reflective light where the light comes from in front of the gaming machine, e.g., from the ambient room.

The proximate display devices 18*a* and 18*b* each have the capacity to be partially or completely transparent or translucent. In a specific embodiment, the relatively flat and thin display devices 18*a* and 18*b* are liquid crystal display devices (LCDs). Other display technologies are also suitable for use. Various companies have developed relatively flat display devices that have the capacity to be transparent or translucent. One such company is Uni-Pixel Displays, Inc., Inc. of Houston Tex., which sells display screens that employ time multiplex optical shutter (TMOS) technology. This TMOS display technology includes: (a) selectively controlled pixels that shutter light out of a light guidance substrate by violating the light guidance conditions of the substrate and (b) a system for repeatedly causing such violation in a time multiplex fashion. The display screens that embody TMOS technology are inherently transparent and they can be switched to display colors in any pixel area. A transparent OLED may also be used. An electroluminescent display is also suitable for use with proximate display devices 18*a* and 18*b*. Also, Planar Systems Inc. of Beaverton OR and Samsung of Korea, both produce several display devices that are suitable for use herein and that can be translucent or transparent. Kent Displays Inc. of Kent OH also produces Cholesteric LCD display devices that operate as a light valve and/or a monochrome LCD panel.

Figure 4C:
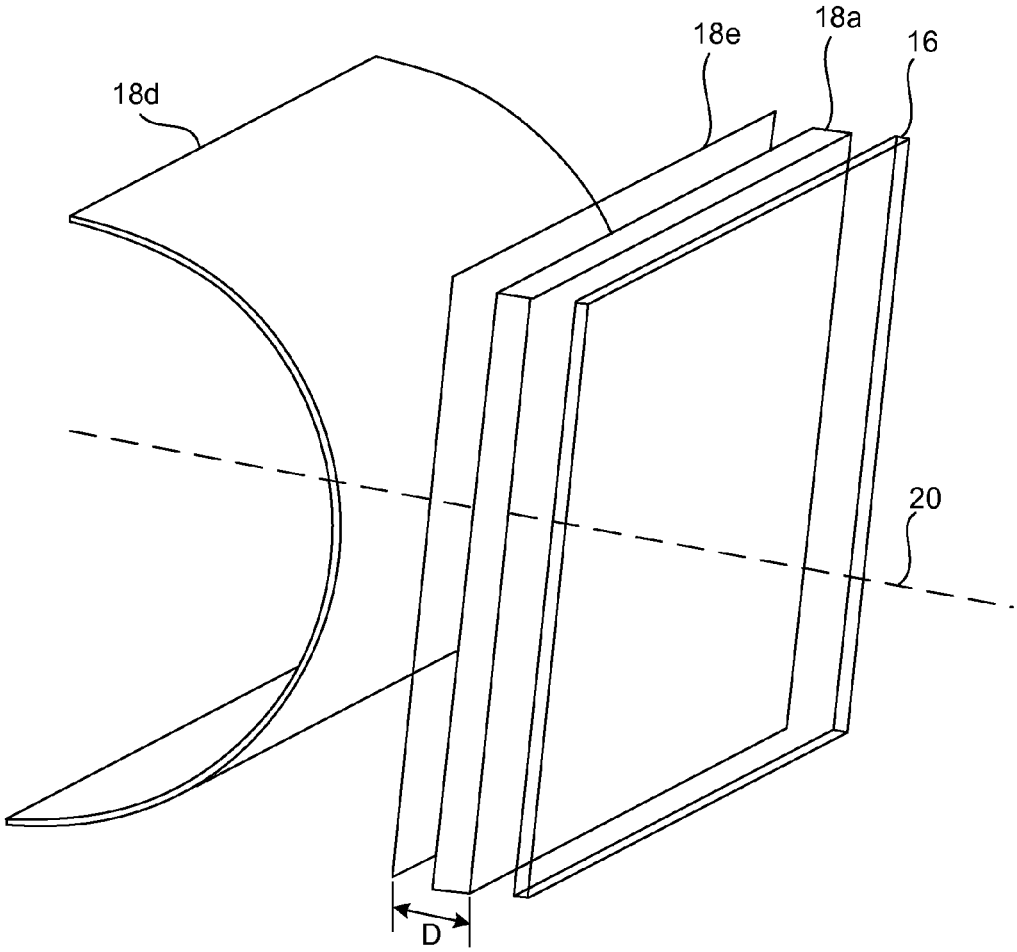
FIG. 4C shows another layered video display device arrangement in accordance with a specific embodiment.

FIG. 4C shows another layered video display device arrangement in accordance with a specific embodiment. In this arrangement, a touchscreen 16 is arranged in front of an exterior LCD panel 18*a*, an intermediate light valve 18*e* and a curved display device 18*d*.

A common line of sight 20 passes through all four layered devices. As the term is used herein, a common line of sight refers to a straight line that intersects a portion of each display device. The line of sight is a geometric construct used herein for describing a spatial arrangement of display devices. If all the proximate display devices are transparent along the line of sight, then a person should be able see through all the display devices along the line of sight. Multiple lines of sight may also be present in many instances.

Light valve 18*e* selectively permits light to pass therethrough in response to a control signal. Various devices may be utilized for the light valve 18*e*, including, but not limited to, suspended particle devices (SPD), Cholesteric LCD devices, electrochromic devices, polymer dispersed liquid crystal (PDLC) devices, etc. Light valve 18*e* switches between being transparent, and being opaque (or translucent), depending on a received control signal. For example, SPDs and PDLC devices become transparent when a current is applied and become opaque or translucent when little or no current is applied. On the other hand, electrochromic devices become opaque when a current is applied and transparent when little or no current is applied. Additionally, light valve 18*e* may attain varying levels of translucency and opaqueness. For example, while a PDLC device is generally either transparent or opaque, suspended particle devices and electrochromic devices allow for varying degrees of transparency, opaqueness or translucency, depending on the applied current level.

In one embodiment, the gaming machine includes a touchscreen 16 disposed outside the exterior video display device 18*a*. Touchscreen 16 detects and senses pressure, and in some cases varying degrees of pressure, applied by a person to the touchscreen 16. Touchscreen 16 may include a capacitive, resistive, acoustic or other pressure sensitive technology. Electrical communication between touchscreen 16 and the gaming machine processor enable the processor to detect a player pressing on an area of the display screen (and, for some touchscreens, how hard a player is pushing on a particular area of the display screen). Using one or more programs stored within memory of the gaming machine, the processor enables a player to activate game elements or functions by applying pressure to certain portions of touchscreen 16. Several vendors known to those of skill in the art produce a touchscreen suitable for use with a gaming machine. Additionally, touchscreen technology which uses infrared or other optical sensing methods to detect screen contact in lieu of pressure sensing may be employed, such as the proprietary technology developed by NextWindow Ltd. of Aukland, New Zealand.

Rear display device 18*d* includes a digital display device with a curved surface. A digital display device refers to a display device that is configured to receive and respond to a digital communication, e.g., from a processor or video card. Thus, OLED, LCD and projection type (LCD or DMD) devices are all examples of suitable digital display devices. E Ink Corporation of Cambridge Mass. produces electronic ink displays that are suitable for use in rear display device 18*d*. Microscale container display devices, such as those produced SiPix of Fremont Calif., are also suitable for use in rear display device 18*d*. Several other suitable digital display devices are provided below.

Referring to FIGS. 5A and 5B, portions 15 of proximate display device 18*a* are significantly transparent or translucent. Pixilated element panels on many non-emissive displays such as LCD panels are largely invisible to a viewer. More specifically, many display technologies, such as electroluminescent displays and LCD panels, include portions that are transparent when no video images are displayed thereon. For example, an electroluminescent display may utilize non-organic phosphors that are both transparent and emissive (such as a tOLED), and addressed through transparent row and column drivers. Pixilated element panels on LCD panels are also available in significantly transparent or translucent designs that permit a person to see through the pixilated panels when not locally displaying an image.

If used, corresponding portions of touchscreen 16 and light valve 18*e* along the lines of sight for portions 15 are also translucent or transparent, or alternatively have the capacity to be translucent or transparent in response to control signals from a processor included in the gaming machine. When portions (or all) of the screens for touchscreen 16, display devices 18*a* and 18*b*, and light valve 18*e* are transparent or translucent, a player can simultaneously see images displayed on the display screen 18*a* (and/or 18*b*)—as well as the images displayed on the interior display devices 18*c*—by looking through the transparent portions 15 of proximate display devices.

In another embodiment, the layered displays in a gaming machine include a design or commercially available unit from Pure Depth of Redwood City, Calif. The Pure Depth technology incorporates two or more LCD displays into a physical unit, where each LCD display is separately addressable to provide separate or coordinated images between the LCDs. Many Pure Depth display systems include a high-brightened backlight, a rear image panel, such an active matrix color LCD, a diffuser, a refractor, and a front image plane; these devices are arranged to form a stack. The LCDs in these units are stacked at set distances.

The layered display devices 18 may be used in a variety of manners to output games on a gaming machine. In some cases, video data and images displayed on the display devices 18*a* and 18*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired.

In a specific embodiment, display devices 18 display co-acting or overlapping images to a person. For example, front display device 18*a* (or 18*b*) may display paylines in transparent portions 15 that illuminate winning combinations of reels 125 disposed on display devices 18*c*.

In another specific embodiment, layered display devices 18 provide 3D effects. A gaming machine may use a combination of virtual 3D graphics on any one of the display devices—in addition to 3D graphics obtained using the different depths of the layered display devices. Virtual 3D graphics on a single screen typically involve shading, highlighting and perspective techniques that selectively position graphics in an image to create the perception of depth. These virtual 3D image techniques cause the human eye to perceive depth in an image even though there is no real depth (the images are physically displayed on a single display screen, which is relatively thin). Also, the predetermined distance, D (between display screens for the layered display devices) facilitates the creation of 3D effects having a real depth between the layered display devices. 3D presentation of graphic components may then use a combination of: a) virtual 3D graphics techniques on one or more of the multiple screens; b) the depths between the layered display devices; and c) combinations thereof. The multiple display devices may each display their own graphics and images, or cooperate to provide coordinated visual output. Objects and graphics in a game may then appear on any one or multiple of the display devices, where reels and other graphics on the proximate screen(s) block the view objects on the distal screen(s), depending on the position of the viewer relative to the screens. This provides actual perspective between the graphics objects, which represents a real-life component of 3D visualization (and not just perspective virtually created on a single screen).

In another specific embodiment, the multiple display devices output video for different games or purposes. For example, the interior display device may output a reel game, while the intermediate display device outputs a bonus game or pay table associated with the interior display, while the exterior and foremost display device provides a progressive game or is reserved for player interaction and video output with the touchscreen. Other combinations may be used.

Controlling transparency of the outer one or two display devices also provides game presentation versatility on a single gaming machine. In one embodiment, an outer or intermediate display device acts as a light valve that controls whether the interior display device is visible, or what portions of the interior display device are visible. For example, window portions of the intermediate display device may be left transparent to permit viewing of a select number video reels arranged behind the light valve.

In another embodiment, the outer display device completely blocks out the interior display device, where the outermost display device is now solely visible and used for game presentation. The gaming machine now resembles a conventional gaming machine that only includes a single LCD panel. The gaming machine may then respond to digital controls to switch between a reel game, a multi-layer/multi-display game, and a simple one-panel LCD game. Other uses of the layered displays are possible and contemplated.

Gaming machine 10 uses the layered display devices 18 to show visual information on the different screens that a player can simultaneously see. Additional sample game presentations and uses of the layered display devices will now be discussed.

In another specific example, the gaming machine generates a game image on an interior display device and a flashing translucent image on a proximate display device. The game could for example, be reels or one or more wheels, and a flashing image on the proximate display could be a translucent line that indicates the payline(s) on the reels. Since some games permit multiple paylines based on the person's wager, this permits the game to show multiple paylines responsive to the person's actions. Alternatively, the proximate display may show a symbol or message that provides a player with helpful information such as a hint for playing the game. Notably, each of these examples allows the person to play the game while viewing the flashing image without having to change his or her line of sight or having to independently find such information from another portion of the gaming machine.

In one embodiment, the gaming machine presents different game types on the layered display devices. For example, the interior and backmost display device may output a main game with reels 125 while a proximate display device shows a bonus game or progressive game. The bonus game or progressive game may result from playing the main game. Again, this permits the player to play the game while viewing a flashing bonus image without having to change his or her line of sight or having to independently find such information from another portion of the gaming machine.

Visual information on each of the distal screens remains visible as long as there are transparent or semi-transparent portions on the proximate screens that permit a user to see through these portions. Transparent portions may be selectively designed and timely activated according to game design, and changed according to game play. For example, if a game designer wants a person to focus on a bonus game on the front screen, they can use an intermediate light valve to black out a distal reel game.

Similarly, visual information displayed on distal transmissive-type screens may obscure overlapping visual information on a proximate screen. When illumination for the layered displays is provided from behind the rear-most display panel, light transmitting from behind layered displays to a proximate display screen can be blocked by an overlapping low transmissive area on a distal screen. Any displayed graphics will result in local attenuation and lower transmissivity through the graphics than would a corresponding "white," or maximally transmissive, window. If illumination from a rear-most backlight is sufficiently attenuated by image information before reaching a proximate screen, an observer may perceive indistinct shapes at lower illumination. Because an image on any level of the layered display may adversely affect an observer's ability to discern the desired visual information, it is usually beneficial to coordinate visual information among and between the various layers such that graphics on proximate displays receive adequate light.

In one embodiment, the layered display devices are all-digital and permit reconfiguration in real time. This permits new or different games to be downloaded onto a gaming machine, and reconfiguration of the three display devices to present a new or different game using any combination of the display devices. For a casino, or other gaming establishment, this permits a single gaming machine to offer multiple games without the need for gaming machine maintenance or replacement when a new game is desired by casino management or customer demand. On one day, the gaming machine may offer games using all the layered display devices. The next day, the same gaming machine may offer a game that only uses an outer LCD panel and touchscreen, where a shutter (or other technology on front display) blocks out the back display devices. Some other subset of the layered displays may also be used. This permits dual-dynamic display device reconfiguration and/or game reconfiguration, at will, by downloading commands to the gaming machine that determine a) what game(s) is played, and b) what display device(s) is used. For example, this allows the same gaming machine to run a reel game one day and a video poker game another day that uses some subset of the display devices.

This reconfiguration of display devices used and games also enables new uses for gaming machines. Traditionally, a casino or other gaming establishment purchased a gaming machine and offered games only according to its display capabilities. If a casino purchased 250 gaming machines that only had LCD panels, and then later decided they wanted to implement reel games or other games that required more than an LCD panel, they were forced to purchase new gaming machines. Gaming machine 10, however, solves this problem for a casino. Accordingly, gaming machines as described herein permit a gaming establishment to switch the number of display devices used by a gaming machine to display a game.

One business advantage of this dual-dynamic display device reconfiguration and/or game reconfiguration is navigating gaming regulations imposed by different jurisdictions, which often change over time. First, each jurisdiction imposes its own set of rules on what games are locally permissible. Second, gaming regulators in each jurisdiction often change the local rules. This is particularly common for new gaming regulators and jurisdictions allowing casinos for the first time. The new gaming regulators may only permit class 2 games at first (e.g., bingo) and later permit class 3 games (video poker and reel games, one year later). Gaming machine 10 allows a casino in this jurisdiction to adapt, instantly, to a regulations change with a) new games and b) new display device arrangements that were already on gaming machine 10 but not previously used. Thus, when some jurisdictions limit the number and types of games that can be played, gaming machines described herein allow a casino to switch games—on the fly without significant gaming machine maintenance or downtime in the casino—when jurisdiction rules change.

One of the display devices in a layered arrangement may also output live video such as television or a movie (or parts of either). For example, the television or movie video may be output on a rear display while a game is played on a proximate display. This permits a person to watch television or a movie while playing a game at a gaming machine, without changing position or line of sight to switch between the game and live video. The live video may also be related to the game being played to enhance enjoyment of that game, e.g., a science fiction movie related to a science fiction game being played or a 1960's television show related to a 1960's television game. The video may also play commercials for the gaming establishment, such as advertisements and infomercials for businesses related to a casino or businesses that pay for the advertising opportunity. Advertisements may include those for a local restaurant, local shows, -house offers and promotions currently offered, menus for food, etc.

Figure 6A:
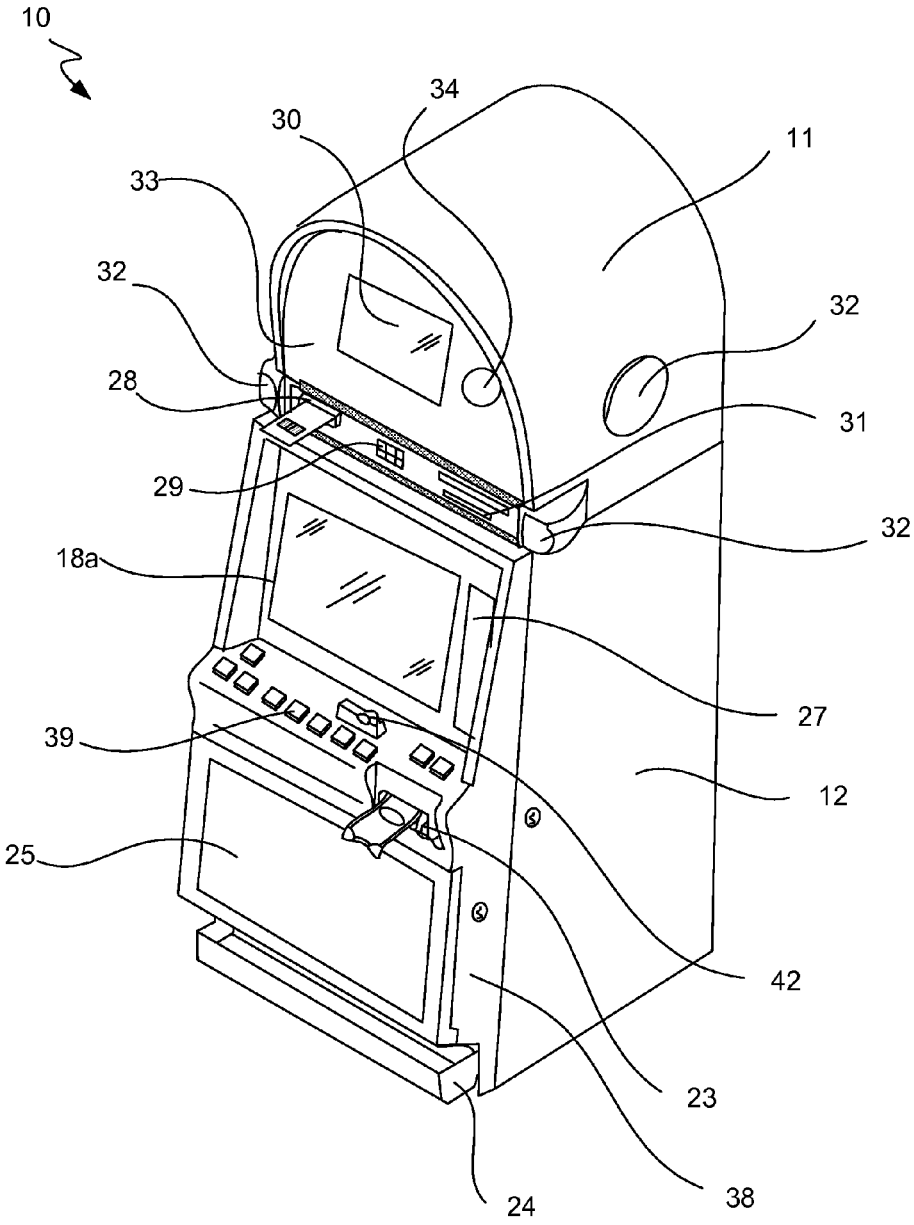
FIGS. 6A and 6B illustrate a gaming machine in accordance with a specific embodiment.
Figure 6B:
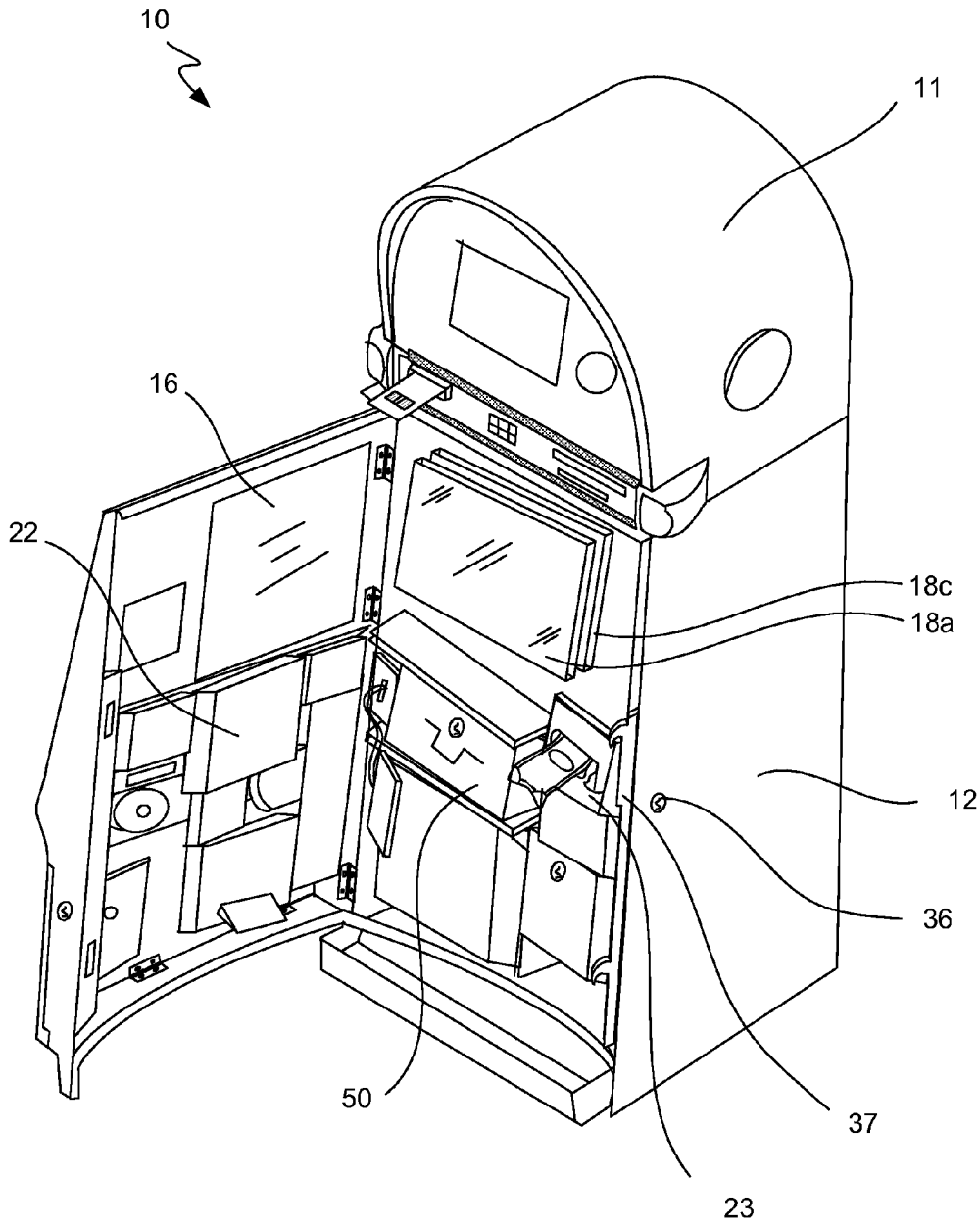

Embodiments described herein may be implemented on a wide variety of gaming machines. For example, the video reels may be output by a gaming machine as provided by IGT of Reno, Nev. Gaming machines from other manufacturers may also employ embodiments described herein. FIGS. 6A and 6B illustrate a sample gaming machine 10 in accordance with a specific embodiment. Gaming machine 10 is suitable for providing a game of chance and displaying video data that includes one or more simulated mechanical imperfections of a mechanical reel.

Gaming machine 10 includes a top box 11 and a main cabinet 12, which defines an interior region of the gaming machine. The cabinet includes one or more rigid materials to separate the machine interior from the external environment, is adapted to house a plurality of gaming machine components within or about the machine interior, and generally forms the outer appearance of the gaming machine. Main cabinet 12 includes a main door 38 on the front of the machine, which opens to provide access to the interior of the machine. The interior may include any number of internal compartments, e.g., for cooling and security purposes. Attached to the main door or cabinet are typically one or more player-input switches or buttons 39; one or more money or credit acceptors, such as a coin acceptor 42, and a bill or ticket scanner 23; a coin tray 24; and a belly glass 25. Viewable through main door 38 is the exterior video display monitor 18*a* and one or more information panels 27.

Top box 11, which typically rests atop of the main cabinet 12, may also contain a ticket printer 28, a keypad 29, one or more additional displays 30, a card reader 31, one or more speakers 32, a top glass 33 and a camera 34. Other components and combinations are also possible, as is the ability of the top box to contain one or more items traditionally reserved for main cabinet locations, and vice versa.

It will be readily understood that gaming machine 10 can be adapted for presenting and playing any of a number of games and gaming events, particularly games of chance involving a player wager and potential monetary payout, such as, for example, a digital slot machine game and/or any other video reel game, among others. While gaming machine 10 is usually adapted for live game play with a physically present player, it is also contemplated that such a gaming machine may also be adapted for remote game play with a player at a remote gaming terminal. Such an adaptation preferably involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or gaming terminal, in that all processing may be done at a remote server, with only the external housing, displays, and pertinent inputs and outputs being available to a player. Further, it is also worth noting that the term "gaming machine" may also refer to a wide variety of gaming machines in addition to traditional free standing gaming machines. Such other gaming machines can include kiosks, set-top boxes for use with televisions in hotel rooms and elsewhere, and many server based systems that permit players to log in and play remotely, such as at a personal computer or PDA. All such gaming machines can be considered "gaming machines" for embodiments described herein.

With reference to FIG. 6B, the gaming machine of FIG. 6A is illustrated in perspective view with its main door opened. In additional to the various exterior items described above, such as top box 11, main cabinet 12 and primary video displays 18, gaming machine 10 also comprises a variety of internal components. As will be readily understood by those skilled in the art, gaming machine 10 contains a variety of locks and mechanisms, such as main door lock 36 and latch 37. Internal portions of coin acceptor 22 and bill or ticket scanner 23 can also be seen, along with the physical meters associated with these peripheral devices. Processing system 50 includes computer architecture, as will be discussed in further detail below.

When a person wishes to play a gaming machine 10, he or she provides coins, cash or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a video display. Usually, during the course of a game, a player is required to make a number of decisions that affect the outcome of the game. The player makes these choices using a set of player-input switches. A game ends with the gaming machine providing an outcome to the person, typically using one or more of the video displays.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device may be stored in a memory device provided on a gaming machine network (e.g., a memory device associated with validation terminal and/or processing system in the network). Any credit on some devices may be used for further games on other gaming machines 10. Alternatively, the player may redeem the device at a designated change booth or pay machine.

Gaming machine 10 can be used to play any primary game, bonus game, progressive or other type of game. Other wagering games can enable a player to cause different events to occur based upon how hard the player pushes on a touch screen. For example, a player could cause reels or objects to move faster by pressing harder on the exterior touch screen. In these types of games, the gaming machine can enable the player to interact in the 3D by varying the amount of pressure the player applies to a touchscreen.

As indicated above, gaming machine 10 also enables a person to view information and graphics generated on one display screen while playing a game that is generated on another display screen. Such information and graphics can include game paytables, game-related information, entertaining graphics, background, history or game theme-related information or information not related to the game, such as advertisements. The gaming machine can display this information and graphics adjacent to a game, underneath or behind a game or on top of a game. For example, a gaming machine could display paylines on a proximate display screen and also display a reel game on a distal display screen, and the paylines could fade in and fade out periodically.

A gaming machine includes one or more processors and memory that cooperate to output games and gaming interaction functions from stored memory. FIG. 7 illustrates a control configuration for use in a gaming machine in accordance with another specific embodiment.

Processor 332 is a microprocessor or microcontroller-based platform that is capable of causing a display system 18 to output video data such as symbols, cards, images of people, characters, places, and objects which function in the gaming device. Processor 332 may include a commercially available microprocessor provided by a variety of vendors known to those of skill in the art. Gaming machine 10 may also include one or more application-specific integrated circuits (ASICs) or other hardwired devices. Furthermore, although the processor 332 and memory device 334 reside on each gaming machine, it is possible to provide some or all of their functions at a central location such as a network server for communication to a playing station such as over a local area network (LAN), wide area network (WAN), Internet connection, microwave link, and the like.

Memory 334 may include one or more memory modules, flash memory or another type of conventional memory that stores executable programs that are used by the processing system to control components in a layered display system and to perform steps and methods as described herein. Memory 334 can include any suitable software and/or hardware structure for storing data, including a tape, CD-ROM, floppy disk, hard disk or any other optical or magnetic storage media. Memory 334 may also include a) random access memory (RAM) 340 for storing event data or other data generated or used during a particular game and b) read only memory (ROM) 342 for storing program code that controls functions on the gaming machine such as playing a game.

A player uses one or more input devices 338, such as a pull arm, play button, bet button or cash out button to input signals into the gaming machine. One or more of these functions could also be employed on a touchscreen. In such embodiments, the gaming machine includes a touch screen controller 16*a* that communicates with a video controller 346 or processor 332. A player can input signals into the gaming machine by touching the appropriate locations on the touchscreen.

Processor 332 communicates with and/or controls other elements of gaming machine 10. For example, this includes providing audio data to sound card 336, which then provides audio signals to speakers 330 for audio output. Any commercially available sound card and speakers are suitable for use with gaming machine 10. Processor 332 is also connected to a currency acceptor 326 such as the coin slot or bill acceptor. Processor 332 can operate instructions that require a player to deposit a certain amount of money in order to start the game.

Although the processing system shown in FIG. 7 is one specific processing system, it is by no means the only processing system architecture on which embodiments described herein can be implemented. Regardless of the processing system configuration, it may employ one or more memories or memory modules configured to store program instructions for gaming machine network operations and operations associated with layered display systems described herein. Such memory or memories may also be configured to store player interactions, player interaction information, and other instructions related to steps described herein, instructions for one or more games played on the gaming machine, etc.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

The processing system may offer any type of primary game, bonus round game or other game. In one embodiment, a gaming machine permits a player to play two or more games on two or more display screens at the same time or at different times. For example, a player can play two related games on two of the display screens simultaneously. In another example, once a player deposits currency to initiate the gaming device, the gaming machine allows a person to choose from one or more games to play on different display screens. In yet another example, the gaming device can include a multi-level bonus scheme that allows a player to advance to different bonus rounds that are displayed and played on different display screens.

Although the foregoing invention has been described in some detail for purposes of clarity of understanding, it will be apparent that certain changes and modifications may be practiced within the scope of the appended claims. Therefore, the present examples are to be considered as illustrative and not restrictive, and the invention is not to be limited to the details given herein, but may be modified within the scope of the appended claims.

What is claimed is:

1. A gaming machine comprising:

a cabinet defining an interior region of the gaming machine, the cabinet adapted to house a plurality of gaming machine components within or about the interior region;

a display device, disposed within or about the interior region, configured to output a visual image in response to a control signal; and at least one processor configured to execute instructions, from memory, that a) permit game play, on the gaming machine and using the display device, of a game of chance with multiple video reels displayed by the display device, and b) display video data, on the display device, that includes one or more simulated visible mechanical imperfections of a mechanical reel in a gaming machine, the one or more simulated visible mechanical imperfections including a dynamic imperfection and the output video data including simulated motion of a video reel.

2. The gaming machine of claim 1 wherein the visible mechanical imperfection includes jitter in a direction orthogonal to a direction of spin for the mechanical reel and the output video data includes simulated jitter of the video reel, or a portion thereof, in a direction orthogonal to a direction of spin for the video reel.

3. The gaming machine of claim 2 wherein the simulated jitter includes periodic jitter corresponding to a rotational speed for the video reel.

4. The gaming machine of claim 1 wherein the visible mechanical imperfection includes reel kick-back in a direction opposite to a direction of spin for the mechanical reel and the output video data includes simulated kick-back of the video reel in a direction opposite to a direction of spin for the video reel.

5. The gaming machine of claim 4 wherein the simulated kick-back occurs after the video reel stops spinning in the direction of spin.

6. The gaming machine of claim 4 wherein the simulated kick-back occurs before the video reel starts spinning in the direction of spin.

7. The gaming machine of claim 1 wherein the visible mechanical imperfection includes dynamic randomness and the output video data includes random motion of the video reel.

8. The gaming machine of claim 1 further including a second display device arranged relative to the first display device such that a common line of sight passes through a portion of the first display device to a portion of the second display device.

9. The gaming machine of claim 8 wherein the second display device is arranged distal to the person relative to the first display device.

10. A gaming machine comprising:

a cabinet defining an interior region of the gaming machine, the cabinet adapted to house a plurality of gaming machine components within or about the interior region;

a first display device, disposed within or about the interior region, configured to output a visual image in response to a control signal and including one or more controllably transparent portions;

a second display device, arranged relative to the first display device such that a common line of sight passes through a portion of the first display device to a portion of the second display device; and at least one processor configured to execute instructions, from memory, that a) permit game play, on the gaming machine and using the second display device, of a game of chance with multiple video reels displayed by the second display device, and b) display video data, on the second display device, that includes one or more simulated visible mechanical imperfections of a mechanical reel in a gaming machine wherein the one or more simulated visible mechanical imperfections include a dynamic imperfection and the output video data includes simulated motion of a video reel.

11. The gaming machine of claim 10 wherein the visible mechanical imperfection includes jitter in a direction orthogonal to a direction of spin for the mechanical reel and the output video data includes simulated jitter of the video reel, or a portion thereof, in a direction orthogonal to a direction of spin for the video reel.

12. The gaming machine of claim 10 wherein the visible mechanical imperfection includes reel kick-back in a direction opposite to a direction of spin for the mechanical reel and the output video data includes simulated kick-back of the video reel in a direction opposite to a direction of spin for the video reel.

13. A method of providing a game of chance on a gaming machine, the method comprising:

displaying the game of chance on a video display device included in the gaming machine, wherein the game of chance includes a set of video reels;

during the game, simulating the movement of symbols on each video reel in the set of video reels on the display device; and for one or more of the video reels in the set of video reels, displaying video data, on the display device, that simulates one or more visible mechanical imperfections of a mechanical reel in a gaming machine wherein the one or more simulated visible mechanical imperfections include a dynamic imperfection and the output video data includes simulated motion of a video reel.

14. The method of claim 13 wherein the visible mechanical imperfection includes jitter in a direction orthogonal to a direction of spin for the mechanical reel and the output video data includes simulated jitter of the video reel, or a portion thereof, in a direction orthogonal to a direction of spin for the video reel.

15. The method of claim 14 wherein the simulated jitter includes periodic jitter corresponding to a rotational speed for the video reel.

16. The method of claim 13 wherein the visible mechanical imperfection includes reel kick-back in a direction opposite to a direction of spin for the mechanical reel and the output video data includes simulated kick-back of the video reel in a direction opposite to a direction of spin for the video reel.

17. The method of claim 16 wherein the simulated kick-back occurs after the video reel stops spinning in the direction of spin.

18. The method of claim 13 wherein the visible mechanical imperfection includes dynamic randomness and the output video data includes random motion of the video reel.

19. The method of claim 13 further including a second display device arranged relative to the first display device such that a common line of sight passes through a portion of the first display device to a portion of the second display device.

20. Logic encoded which is stored in a non-transitory computer readable medium, which when executed by a computer to provide a game of chance on a gaming machine, comprises:

instructions for displaying the game of chance on a video display device included in the gaming machine, wherein the game of chance includes a set of video reels;

instructions for displaying the simulation the movement of symbols on each video reel in the set of video reels on the display device; and instructions for displaying video data, for one or more of the video reels in the set of video reels, on the display device, that simulates one or more visible mechanical imperfections of a mechanical reel in a gaming machine wherein the one or more simulated visible mechanical imperfections include a dynamic imperfection and the output video data includes simulated motion of a video reel.

* * * * *